US006000792A

United States Patent [19]

Koizumi et al.

[11] Patent Number: 6,000,792

[45] Date of Patent: Dec. 14, 1999

[54] INK JET APPARATUS PROVIDED WITH AN IMPROVED RECOVERY MECHANISM

[75] Inventors: Yutaka Koizumi, Yokohama; Toshiaki Hirosawa, Hiratsuka; Jiro Moriyama; Torachika Osada, both of Yokohama, all of Japan

[73] Assignee: Canon Kabushiki Kaisha, Tokyo, Japan

[21] Appl. No.: 08/661,884

[22] Filed: Jun. 11, 1996

Related U.S. Application Data

[63] Continuation of application No. 08/113,187, Aug. 30, 1993, abandoned.

[30] Foreign Application Priority Data

| | | | |
|---|---|---|---|
| Sep. 2, 1992 | [JP] | Japan | 4-234669 |
| Sep. 25, 1992 | [JP] | Japan | 4-280958 |
| Oct. 26, 1992 | [JP] | Japan | 4-287572 |

[51] Int. Cl.[6] ..... B41J 2/175

[52] U.S. Cl. ..... 347/89; 347/92; 347/93; 347/30; 347/33; 347/42

[58] Field of Search ..... 347/22, 23, 30, 347/32, 33, 40, 42, 90, 89, 92, 93

[56] References Cited

U.S. PATENT DOCUMENTS

| | | | |
|---|---|---|---|
| 4,153,902 | 5/1979 | Kanayama | 347/93 X |
| 4,783,670 | 11/1988 | Conta et al. | 347/93 X |
| 4,864,329 | 9/1989 | Kneezel et al. | 346/140 R |
| 4,896,172 | 1/1990 | Nozawa et al. | 347/89 X |
| 4,947,191 | 8/1990 | Nozawa et al. | 347/30 |
| 5,128,690 | 7/1992 | Nozawa | 347/30 |
| 5,216,446 | 6/1993 | Satoi et al. | 347/65 |
| 5,231,424 | 7/1993 | Kaneko et al. | 347/89 X |

FOREIGN PATENT DOCUMENTS

| | | | |
|---|---|---|---|
| 0500068 | 8/1992 | European Pat. Off. . | |
| 62-111751 | 5/1987 | Japan | 347/33 |
| 3-277556 | 12/1991 | Japan . | |
| WO8808370 | 11/1988 | WIPO . | |

*Primary Examiner*—John Barlow
*Assistant Examiner*—Craig A. Hallacher
*Attorney, Agent, or Firm*—Fitzpatrick, Cella, Harper & Scinto

[57] ABSTRACT

An ink jet recording apparatus includes a recording head having discharging ports which discharge a recording liquid, a capping device capable of being mounted on the recording head, a pressure device which enables the recording liquid to flow under pressure in the ink supply passages to the recording head, and pressurizes the interior of the recording head when the capping device is mounted. A first ink supply tube to conductively connect the pressure device and the recording head, a second ink supply tube conductively connects the recording head and a recording liquid reservoir container; a conductive tube conductively connects the first ink supply tube and the second ink supply tube, and a controller controls the flow in the conductive tube, hence making it possible to remove air bubbles in the ink supply systems and ink passages easily and effectively by providing a conductive tube for a conventional ink supply systems.

25 Claims, 19 Drawing Sheets

INK JET APPARATUS PROVIDED WITH AN IMPROVED RECOVERY MECHANISM

This application is a continuation of application Ser. No. 08/113,187 filed Aug. 30, 1993 abandoned.

BACKGROUND OF THE INVENTION

1. Field of the Invention

The present invention relates to an ink jet recording apparatus provided with a discharge recovery systems to eliminate from the discharging member the defective discharges brought about by the clogging due to dust particles and the increase of viscosity of ink, or the mixture of air bubbles or the like.

2. Related Background Art

FIG. 1 is a perspective view showing an example of the recording head used for an ink jet recording apparatus according to the prior art. Here, a reference numeral 1 designates a discharging element comprising the ink passages in which the heat generating elements composed of $HfB_2$ and others are integrally arranged in parallel for enabling discharging energy to act on the recording liquid (hereinafter referred to as ink); the open orifices 10 which are provided in the front part of each of the ink passages; and a common liquid chamber where the ink is retained for supply to each of the ink passages, among some others. Thus, the ink droplets are discharged from the orifices to execute an image formation. A reference numeral 3 designates a base plate on which the element 1 is adhesively bonded, and 2, a front plate fixed by bolts or other tightening members to the end faces of the discharging element 1 and base plate 3, having the apertures which enable the orifices 10 to face a recording medium such as a recording sheet directly. Each of the members 15, 16, and 17 is the one constituting a part of the ink supply systems; 15 is an elbow type connecting member which leads the ink into the common liquid chamber in the discharging element; 17 is a filter unit arranged on the way of the ink supply passages from an ink tank or the like which serves as an ink supply source; and 16 is a supply tube connecting between the connecting member 15 and the filter unit 17.

FIG. 2 and FIG. 3 are cross-sectional views taken along the vertical and horizontal planes of the recording head shown in FIG. 1, respectively, which represent a state where a cap 4 is coupled to cover the entire surface of the aperture plane of the orifices 10 of the discharging element through the front plate 2 when a discharge recovery processing is executed.

The ink passages 12 corresponding to a plurality of orifices 10 are connected to the so-called eave portion or appentice cave portions 13. The appentice cave portions 13 are connected to the common liquid chamber 14. A reference numeral 11 designates an energy generating element provided in the ink passage 12 to cause the discharging energy to act on the ink, which is formed by a heat generating element, for example. In the filter unit 17, a filter 100 composed of ridge meshes, for example, is provided in order to remove fine dust particles and air bubbles.

FIG. 4 is a block diagram showing the discharge recovery systems in an ink jet recording apparatus according to the prior art. In a usual recording state, the cap 4 is set in an appropriate position where it does not hinder any recording operation. At the same time, a valve B2 is opened, while valves B1 and B3 are kept in the closed condition. Ink is supplied from the ink tank 6 to the discharging element 1 by the application of the capillary phenomenon through the valve B1. When a discharge recovery operation is executed, the cap 4 is installed on the discharging element 1. Then, at first, the valves B1, B2, and B3 are kept in the open state. In this state, a pump 7 is driven to send the ink from the ink tank 6 into the ink supply passages under pressure, thus circulating it through the ink tank 6→ink supply passage $L_1$→discharging element 1→ink supply passage $L_2$→ink tank in that order to remove air bubbles in the ink supply passages $L_1$ and $L_2$ as well as in the discharging element 1. Then, by closing the valve B1, the pressurized ink is supplied to the discharging element 1 so that the ink is forcibly discharged from the orifices 10.

At this juncture, the fine dust particles, the over viscous ink resulting from the evaporation of the ink solvent, and the air bubbles contained in the ink, which are among those causes of the defective discharge, are all exhausted from the discharging element 1 together with the ink discharged from the orifices. For example, as shown in FIG. 3, the ingressive fine air bubbles a in the ink passages 12 are removed from the orifices 10 together with the ink when the pump 7 is driven. The ink thus discharged from the orifices 10 are received by the cap 4 and led out to a waste ink tank 5.

FIG. 5 is a diagram showing the hydrodynamic equivalent circuit for ink in the conventional. apparatus at the time of discharge recovery operation. Here, given the pressure exerted by the pump 7 as ΔP; the number of nozzles, as n; the fluid resistance per nozzle of the nozzles 12, as R1; fluid resistance in the appentice caves 13, as RH; fluid resistance in the common liquid chamber 14, as RC; fluid resistance in the filter unit 17, as RF; fluid resistance in any portions between the ink tank 6 to the common liquid chamber 14 other than the filter unit 17, as RS; and flow rate per one nozzle of the nozzles 12 when pressurized by the pressure ΔP, as q, the following relationship will be satisfied at the time of discharge recovery operation:

$$\Delta P = qR1 + nq\ (RH+RC+RF+RS) \quad (1)$$

$$\therefore q = \Delta P / \{R1 + n\ (RH+RC+RF+RS)\} \quad (2)$$

Usually, the supply systems are designed to obtain the relationship of R1>>RH+RC+RF+RS. However, in a recording head having a mode that the nozzles 12 are arranged in a number corresponding to the recording width, that is, the so-called full-multi type recording head, the number of the nozzles n becomes great, and the flow rate per nozzle q becomes extremely small. Also, as shown in FIG. 8, if there exist ingressive air bubbles a, dust particles, and the like in the nozzles 12, the fluid resistance R1 in the nozzles in which the air bubbles or others exist becomes high. Therefore, the flow rate to the nozzle where the defective discharge takes place becomes still smaller than to the nozzle in the normal state.

As a result, when the conventional recovery systems are employed, the nozzle which has brought about the defective discharge may not be restored to the normal condition, or the discharge recovery processing should be repeated before it is restored.

Also, it is necessary to make the pressure greater in order to overcome such a fluid resistance as this. Hence, there may be a need for the provision of a greater pump 7, leading to the increased consumption of ink, and still more, to the enhancement of the strength of each connecting part between the members to enable them to withstand the increased pressure.

Also, in the conventional discharge recovery systems, although the air bubbles, dust particles, and others in the nozzles can be removed, it is still difficult to completely remove the dust particles and ink droplets adhering to the circumference of the apertures for discharging.

Meanwhile, the filter 100 provided for the ink supply passage is arranged to prevent the dust particles from being ingressive into the recording head 1 (the common liquid chamber 14 and ink passages 12) from the ink supply systems. The smaller the meshes of a filter of the kind, its effectiveness is greater, but the smaller the meshes of the filter, the greater becomes the fluid resistance RF in the filter portion. Thus, the pressure loss will become greater at the time of discharging the ink, leading to the increased frequency of the defective discharge.

To counteract this, it may be attempted to select the filter with a view to avoiding the defective discharges in the entire discharging ports while reducing the pressure loss. In this case, however, the required area of the filter becomes great particularly when the full-multi head having many numbers of discharging ports should be arranged. Therefore, the recording head 1 must inevitably be large in its size as the structure requires the filter to be arranged for the recording head 1 (in the common liquid chamber 14). This is a disadvantage encountered in this respect. Also, in a structure that the filter is installed on the way of the ink passage, it should be possible to adopt a filter having a large area comparatively easily, but there is still a disadvantage that the handling of the recording head 1 becomes inconvenient because it is necessary to keep the ink supply tube connected to the recording head 1 at all times. Moreover, the problems are encountered in that the assembling operation becomes difficult in the process of fabricating the recording head, and that there is a possibility that the dust particles can enter after the replacement of the heads if such a type is adopted as to make the detachment and replacement possible individually on the ink supply side and the recording head side.

SUMMARY OF THE INVENTION

The present invention is designed with a view to solving the above-mentioned problems in the prior art. It is an object of the invention to provide an ink jet recording apparatus capable of executing a highly reliable and exact recovering process with which to recovery the abnormal ink discharging brought about by the clogging due to dust particles and others in the ink discharging apertures of the recording head, the increase in the viscosity of ink, the mixture of air bubbles, or the like, or to eliminate the causes of the abnormal ink discharging due to the ink droplets, foreign substances, or the like adhering to the circumference of the ink discharging apertures.

It is another object of the present invention to provide an ink jet recording apparatus provided with a recording head having a plurality of discharging ports to discharge a recording liquid; capping means which can be installed on the recording head; pressure means for pressurizing the interior of the recording head by supplying the recording liquid under pressure to the ink supply passage connected to the recording head when the capping means is installed to cover the head; a first ink supply tube which conductively connects between the pressure means and the recording head; a second ink supply tube which conductively connects the recording head and the container which retains the recording liquid; a conductive tube which connects the first ink supply tube and second ink supply tube; and a control means which controls the flow in the conductive tube.

It is still another object of the present: invention to provide an ink jet recording apparatus provided with a recording head having a plurality of ink discharging apertures, and an ink suction unit to suck the ink in the ink discharging apertures, in which the foregoing ink suction unit comprising a sucking portion which covers a part of the ink discharging apertures, among such plurality of the ink discharging apertures, in order to suck the ink, and a shifting means which shifts the sucking portion along the surface of the ink discharging apertures.

It is a further object of the present invention to provide an ink jet recording apparatus comprising an ink jet recording means for discharging ink onto a recording material for recording in which electrothermal transducers, a common liquid chamber, liquid passages, and discharging ports are provided; a first substrate supported by a second substrate which has an ahead larger than that of the first substrate; a first filter connected to the common liquid chamber which is provided on both ends of a ceiling plate above the first substrate; a second filter connected to the first filter which is provided on both ends of the second substrate; and a detachable connecting means through which each of the second filter is connected to an ink tank.

DETAILED DESCRIPTION OF THE PREFERRED EMBODIMENTS

Figure 1:
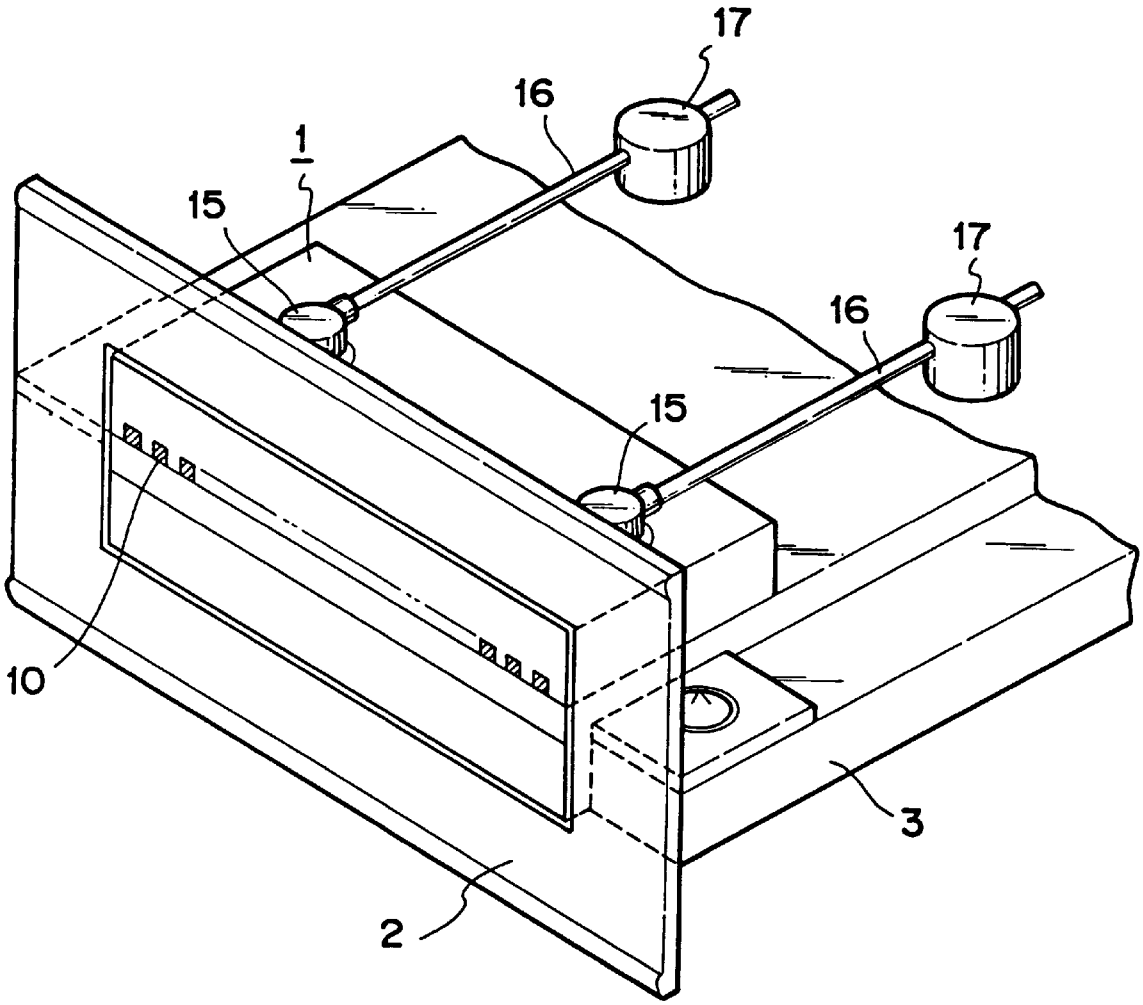
FIG. 1 PRIOR ART
FIG. 1 is a perspective view schematically showing a structural example of an ink jet recording head.
Figure 2:
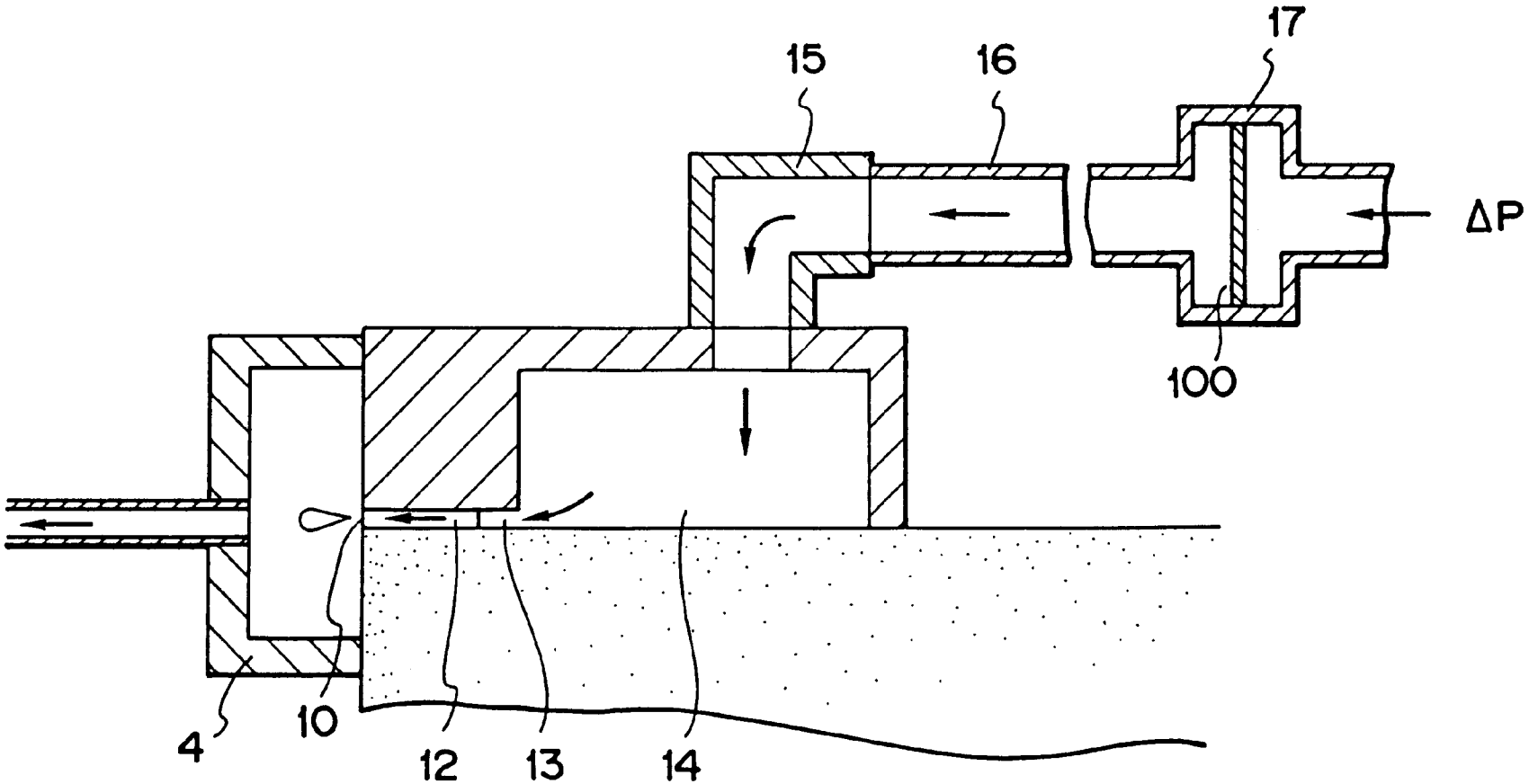
FIG. 2 PRIOR ART
FIG. 2 is a vertical section of the ink jet recording head shown in FIG. 1.
Figure 3:
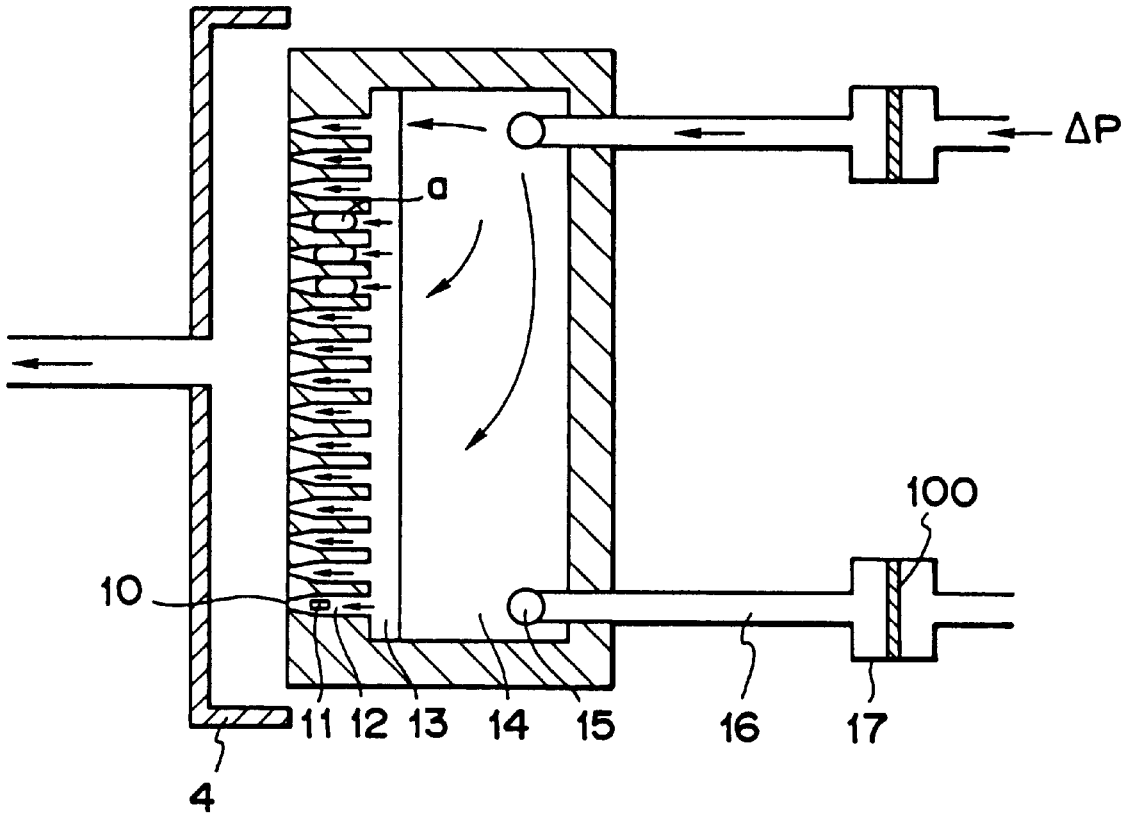
FIG. 3 PRIOR ART
FIG. 3 is a horizontal section of the ink jet recording head shown in FIG. 1.
Figure 4:
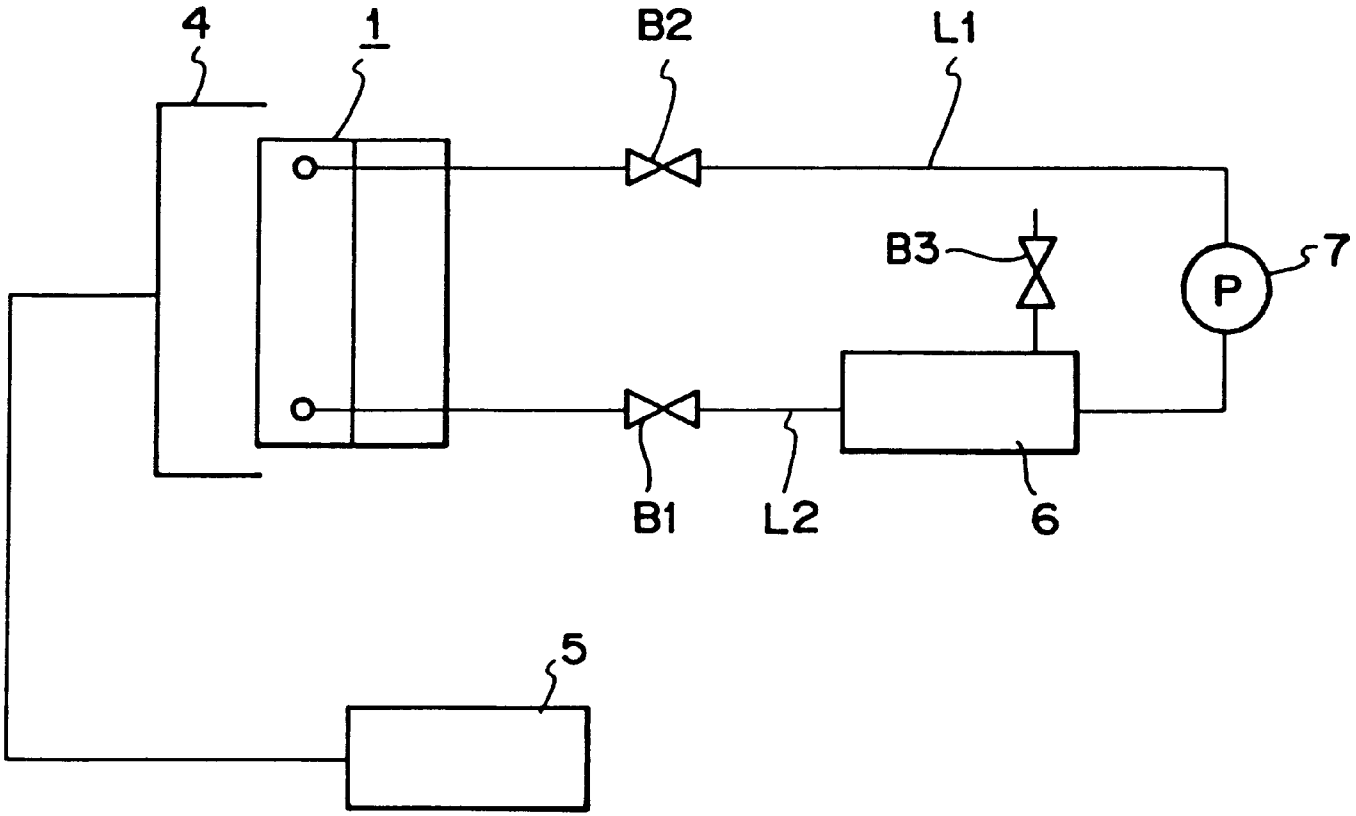
FIG. 4 PRIOR ART
FIG. 4 is a block diagram showing the ink supply recovery systems of an ink jet recording apparatus.
Figure 5:
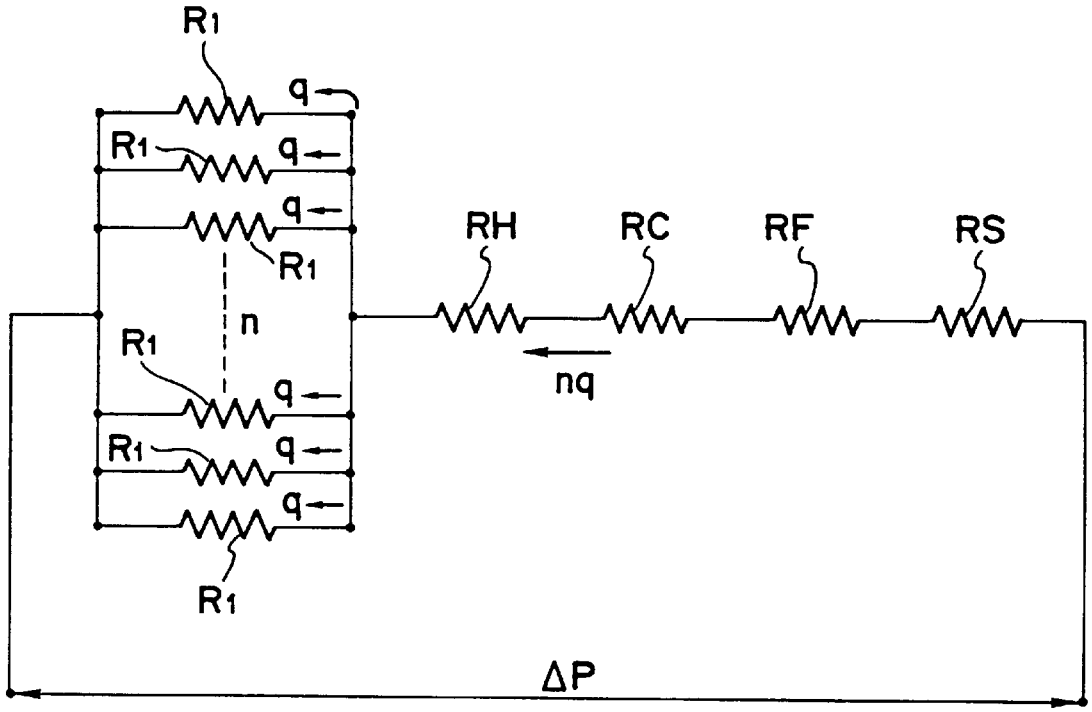
FIG. 5 PRIOR ART
FIG. 5 is a block diagram showing the hydrodynamic equivalent circuit of the ink supply recovery systems of an ink jet recording apparatus.

Hereinafter, with reference to the accompanying drawings, the description will be made of the embodiments according to the present invention.

Here, in each of the drawings of the embodiments, the same reference marks are provided for the corresponding parts of the constituent elements shown in the drawings illustrating the prior art, and the description thereof will be omitted.

(Embodiment 1)

Figure 6:
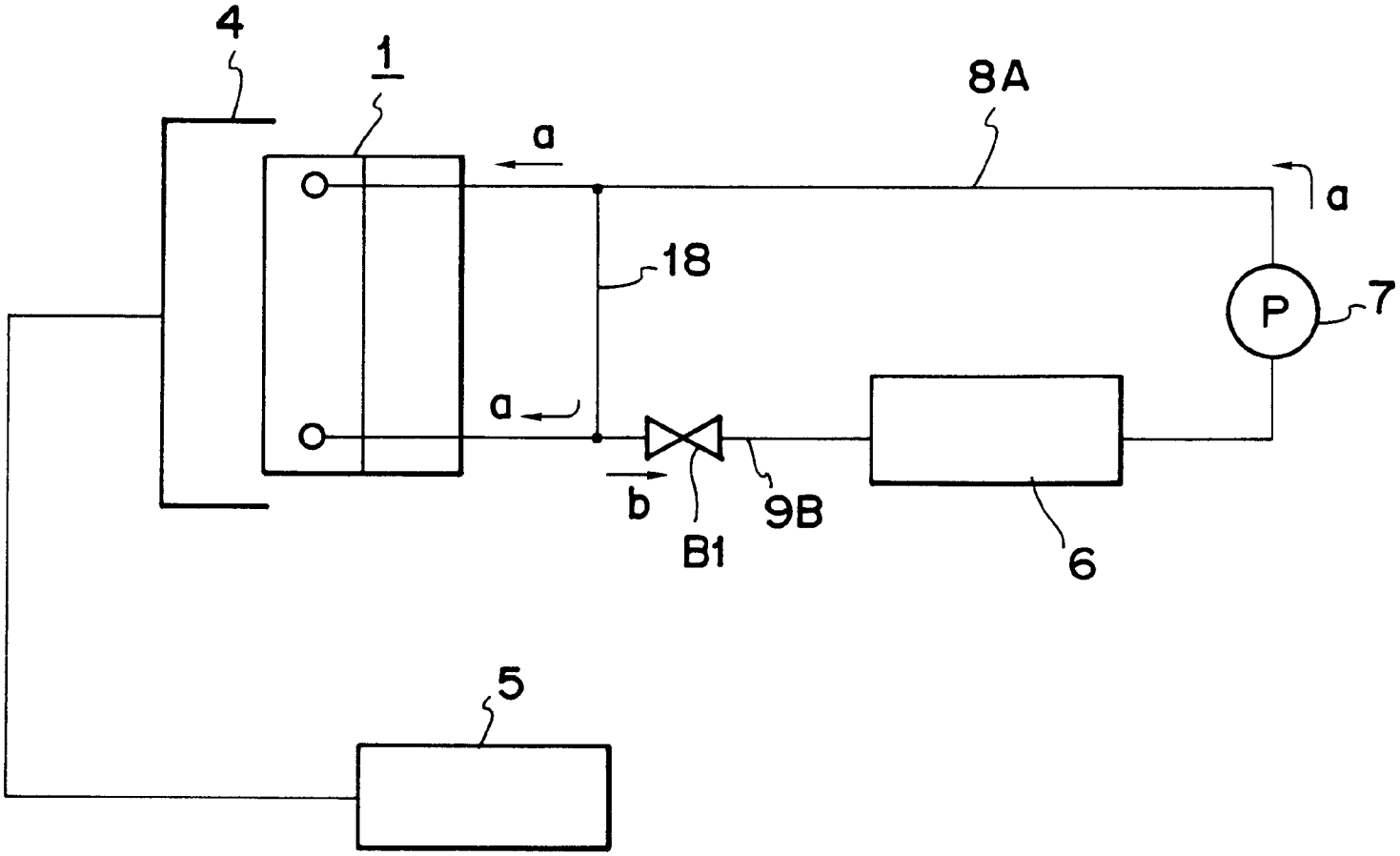
FIG. 6 is a block diagram showing an example of the ink jet recording apparatus for which the present invention is adopted.

FIG. 6 is a block diagram showing an example of the recovery systems of an ink jet recording apparatus according to the present invention.

Here, a reference numeral 8A designates an ink supply tube which connects an ink tank 6 and a discharging element 1 through a pump 7; 9B, an ink supply tube which connects the element 1 and ink tank 6; and 18, a conductive tube which connects the ink supply tube 8A and ink supply tube 9B.

When any disabled discharge takes place in recording or air bubbles are generated in the ink supply passages while left intact for a long period, the valve B1 is closed at first, and then, ink is supplied by the pump 7 under pressure from the ink tank 6 in the direction indicated by an arrow a. In other words, the ink is supplied in the passages in the following two routes: the ink tank 6→pump 7→ink supply tube 8A→discharging element 1→nozzles 12, and the ink tank 6→pump 7→ink tank 8A→conductive tube 18→ink supply tube 9B→discharging element 1→nozzles 12. In this way, the air bubbles generated in the tubes, the air bubbles mixed in the nozzles, and the like are all exhausted to the exterior through the nozzles. Also, the ink is pressurized in the filter unit 17 which is attached to the discharging element 1 before the ink flows out from the ink passage, thus solving the problem that the air bubbles are still retained in the filter unit 17. Then, the valve B1 is released to enable the ink to flow in the direction indicated by an arrow b so that the ink flows also in the ink supply tube 9B between the conductive tube 18 and the ink tank 6, thus filling the ink in the entire ink supply systems reliably.

Subsequently, the pump 7 is suspended with the valve B1 kept in release. Then, the printing is ready at any time.

Figure 7:
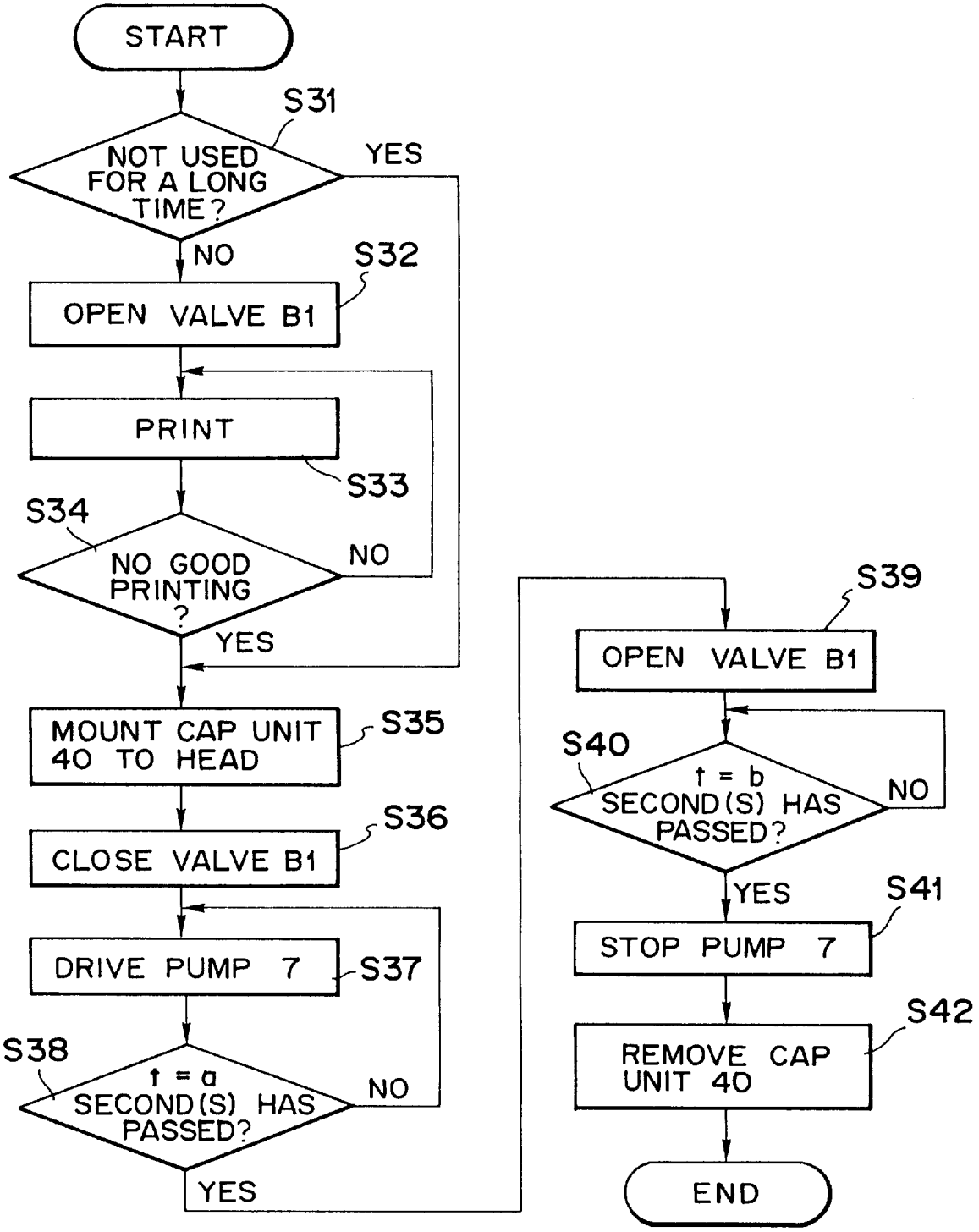
FIG. 7 is a flowchart showing the recovery processing procedures.

FIG. 7 is a flowchart showing an example of the recording and discharge recovery processing procedures of an ink jet apparatus according to the present invention.

At first, in step S31, whether the apparatus is in use for a long time or not is determined. If the printing is ready, the valve B1 is released (step S32), and then, the ink is supplied from the ink tank 6 by the capillary phenomenon to the discharging element 1 through the ink supply tube 9B and conductive tube 18 for printing on a recording medium (step S33). If it is found that the apparatus is not in use for a long time in the step S31 or any defective printing is found in the step S34, the cap unit 4 is at first installed on the recording head H (step S35) in order to prevent the apparatus from being stained even if the ink overflows out of the ink passages. Then, the valve B1 is closed (step S36), and the pump 7 is driven (step S37). At this juncture, the pressurized ink is conducted in the passages from the pump 7 to the discharging element 1 through the ink supply tube 8A, conductive tube 18, and ink supply tube 9B. As a result, the ink is ejected from the orifices 10 to remove the dust particles, air bubbles, and others which have caused the defective discharging.

Whether this state has been kept continuously in a given period of time (here, a seconds) or not is determined (step S38). After a given time has elapsed, the valve B1 is released (step S39) to conduct the pressurized ink also into the passages from the valve B1→ink supply tube 9B→ink tank 6. As a result, the ink is reliably filled in the ink passages. Further, in step S40, whether this state has been kept continuously in a given period of time (here, b seconds). After the given time has elapsed, the pump 7 is suspended (step S41), and the cap unit 4 is caused to retract from the discharging element 1 (step S42). Thus, the printing is terminated.

As described above, just by arranging a conductive tube in the conventional ink supply systems, it becomes possible to remove the air bubbles in the ink supply systems and ink passages easily by means of a small pump. In this respect, the present invention is extremely effective and is, of course, easily applicable to a recording head having a mode in which a plurality of the ink passages are arranged irrespective of the range of the arrangement or the number of the heads which corresponds to the entire width of a recording medium or to those having the arrangement or the number which is less than the foregoing ones; or to the heads for a multi type printer or a serial printer; or, further, in any cases irrespective of the structures of the ink supply systems.

(Embodiment 2)

Figure 8:
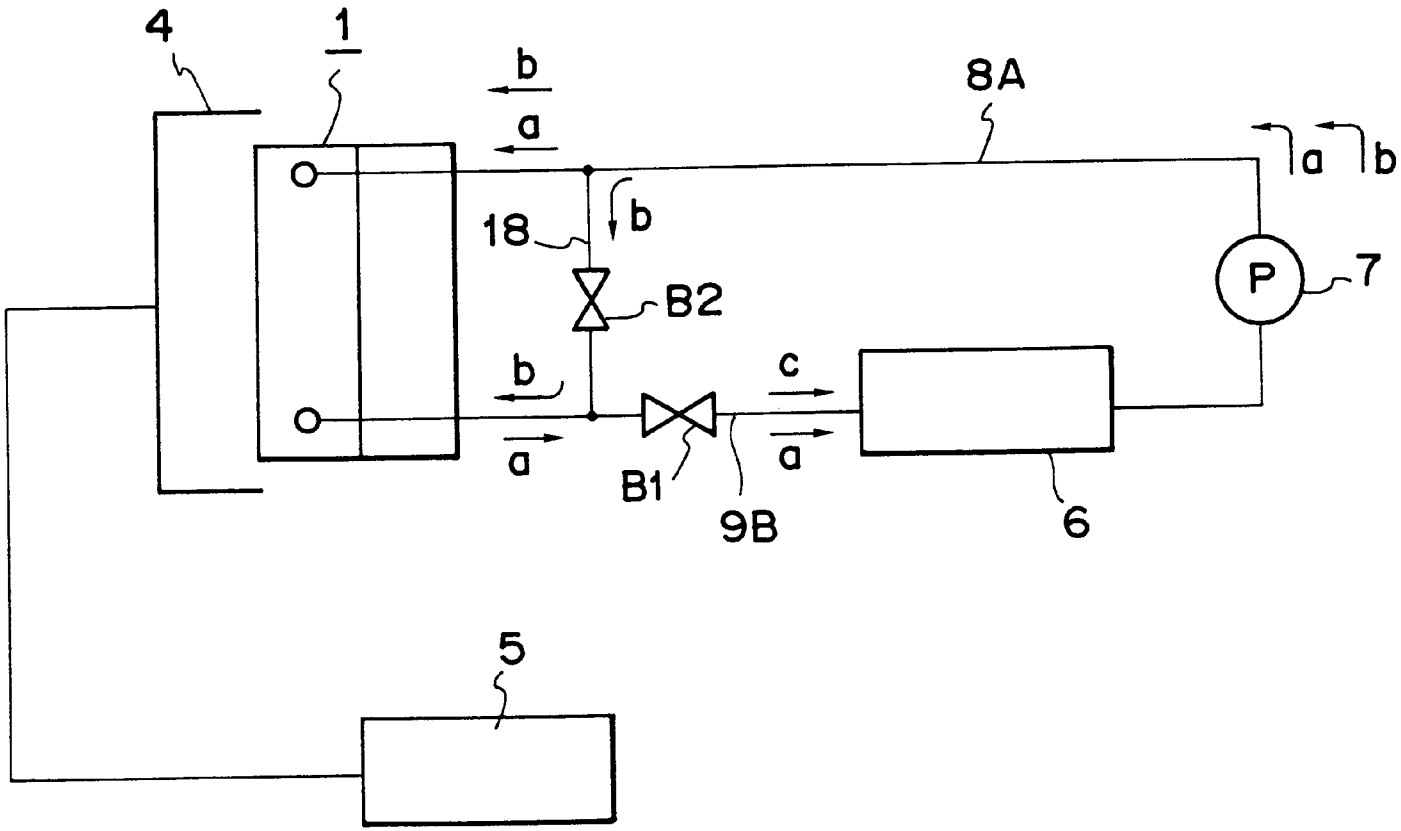
FIG. 8 is another example of the ink jet recording apparatus for which the present invention is adopted.

FIG. 8 is a block diagram showing an example of the recovery systems according to an embodiment of the ink jet recording apparatus of the present invention.

Here, a reference numeral 8A designates an ink supply tube which connects an ink tank 6 and a discharging element 1 through a pump 7; 9*b*, an ink supply tube which connects the discharging element 1 and the ink tank 6; and 18, a conductive tube which connects the ink supply tube 8A and ink supply tube 9B.

At first, the recovery operation is divided into two, and the description will be made of the operations in each case.

The first mode is concerned with a case where the defective recording takes place due to the ingressive air bubbles in the ink passage or the adhesion of dust particles or the like to the orifices. In such a case as this, no air bubbles are mixed in the ink supply systems, and thus, the ink is filled. Then, it will suffice if only just a little amount of ink is allowed to flow out from the ink passages. Therefore, the valve B1 is at first released. Further, the valve B2 is closed. Then, the pump 7 is driven to allow the ink to circulate in the direction indicated by an arrow a, that is, the ink tank 6→pump 7→ink supply tube 8A→common liquid chamber→ink supply tube 9B→ink tank 6. At this juncture, by the ink flow from the common liquid chamber to the nozzles, it is possible to remove the air bubbles, dust particles, and the like in the nozzles easily. Also, since the majority of the pressurized ink by the pump 7 returns to the ink tank 6 through the circulating route, no ink is wasted.

The second mode is concerned with a case where the ink jet recording apparatus is not in use for a long time and is left intact so that the air bubbles are retained in the ink supply tubes, or a considerable amount of air bubbles are mixed in the ink supply tubes when the recording heads are replaced due to some trouble or some other reasons. In this case, if the pump 7 is driven as if in the first mode, the ink cannot be circulated sufficiently due to the resultant pressure loss brought about by the flow out of ink from many of the ink passages or the air bubbles remain in the filter unit. In the worst case, the ink cannot pass through the filter unit at all. In such a case as this, therefore, the valve B1 is closed at first, and then, the valve B2 is released. Subsequently, the pump 7 is driven to circulate the pressurized ink through the route in the direction indicated by an arrow b: the ink tank 6→pump 7→ink supply tube 8A→common liquid chamber, and the ink tank 6→pump 7→ink supply tube 8A→conductive tube 18→ink supply tube 9B→common liquid chamber. At this juncture, all the air bubbles retained in the ink passages are forced by pressure to flow out from them. After the ink has been sent under pressure in a given period of time, the valve B1 is released to make the flow possible from the ink supply tube 9B→the ink tank 6 in the direction indicated by an arrow c to cause all the air bubbles remaining in that section to return to the ink tank 6. Then, the ink is filled in the passages.

In either case of the first and second modes, the pump 7 is suspended subsequent to the operations described above, and the valves B1 and B2 are released, thus making the printing ready at any time.

Figure 9:
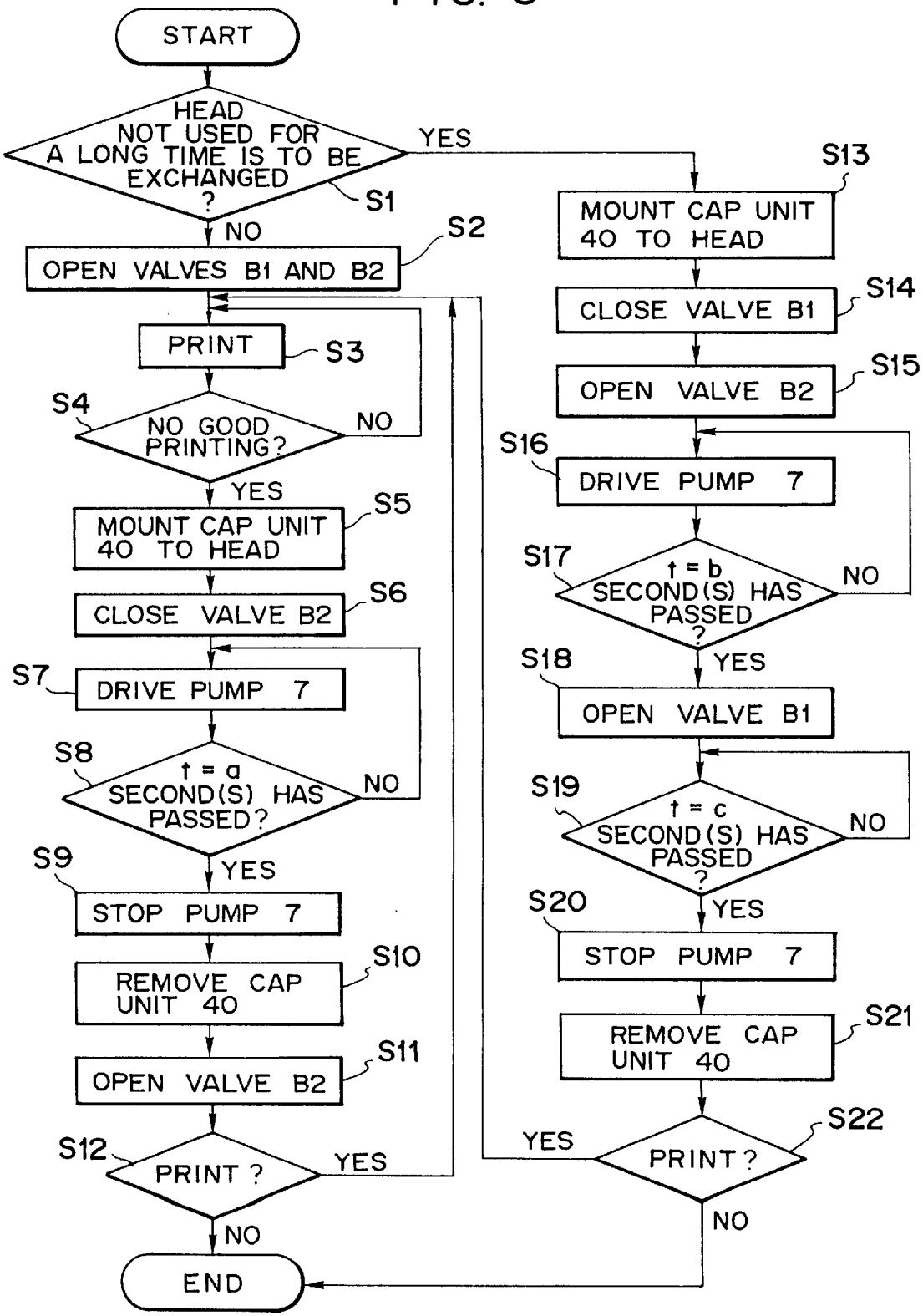
FIG. 9 is a flowchart showing the recovery processing procedures.

FIG. 9 is a flowchart showing an example of the recording head and discharge recovery processing procedures.

At first, in step S1, whether a large amount of air bubbles are mixed in the ink supply passages is determined when the apparatus is out of use for a long time or the heads are replaced. In the step S1, if it is found that no air bubbles are mixed in the ink supply passages, the printing is possible immediately. Thus, the valves B1 and B2 are released (step 52) to make ready the ink supply from the ink tank 6 by the capillary phenomenon to the discharging element 1 through the ink supply tube 9B and conductive tube 18 (step S3). Then, in step S4, whether any defective printing has taken place or not is determined. If any defect occurs in printing, the cap unit 4 is installed on the recording head 1 at first (step S5) in order to prevent the apparatus from being stained even if the ink overflows from the nozzles. Then, the valve B2 is closed (step S6). The pump 7 is driven (step 7). At this juncture, the pressurized ink is conducted from the pump 7 to the discharging element 1 through the ink supply tube 8A, hence removing the air bubbles and others which have caused the defective discharging when the ink is ejected from the ink passages. However, the majority of the pressurized ink sent by the pump 7 is arranged to return from the discharging element 1 to the ink tank through the ink supply tube 9B at that time. Hence, the recovery operation can be executed with the least possible consumption of ink.

Whether this state has continued for a given period of time (here, a seconds) or not is determined (Step S8), and the pump 7 is suspended (step S9) to allow the cap unit 4 to retract from the discharging element 1 (step S10). Then, the valve B2 is released (step S11). In this state, whether or not the printing has finished is determined (step S12). If it is found that the printing has finished, the printing is terminated. Now, in the step S1, when a considerable amount of the air bubbles is mixed in the ink supply passages because the apparatus is out of use for a long time, the recording heads are replaced, or the like, the cap unit 4 is installed to the recording head 1 (step S13) in order to prevent the apparatus from being stained even if the ink overflows from the ink passages. Then, the valve B1 is closed (step S14) while the valve B2 is released (step S15). The pump 7 is driven (step S16). At this juncture, the pressurized ink is conducted from the pump 7 to the passage connected to the discharging element 1 through the ink supply tube 8A, conductive tube 18, and ink supply tube 9B so that the air bubbles existing in the ink supply passages are all forced by pressure to flow out of the passages. Whether this state has continued for a given period of time (here, b seconds) or not is determined (step S17). If affirmative, the valve B1 is released (step S18) to conduct the pressurized ink also to the passage from the valve B1→ink supply tube 9B→ink tank 6. As a result, the ink is filled in each of the ink passages reliably. Further, whether this state has continued for a given period (here, c seconds) or not is determined (step S19). Then, the pump 7 is suspended (step S20) to allow the cap unit 4 to retract from the discharging element 1 (step S21). In step S22, whether the printing is executed or not is determined. If affirmative, the procedure will return to the step S3. If negative, the printing will be terminated.

According to the present invention, by the provision of a conductive tube which connects two ink supply tubes arranged for a discharging element, it becomes possible to provide at a low cost an ink supply systems capable of executing the recovery operation reliably by the pressure means as in the conventional systems even for a recording head having an extremely large number of nozzles.

Also, by the provision of a conductive tube connecting the two ink supply tubes arranged for the discharging element and a valve controlling the flow in the conductive tube in an ink jet recording apparatus having a plurality of orifices, it is possible to provide at a low cost the ink supply systems capable of executing the recovery operation by the use of conventional pressure means reliably with the least possible consumption of ink required when a considerable amount of air bubbles are retained in the ink supply passages subsequent to the replacement of the recording heads or after the long period of time during which the heads are left intact, or the defective printing takes place due to the generation of fine air bubbles in the vicinity of the nozzles even for the recording head having an extremely large number of nozzles.

So far the description has been made of an improved recovery mechanism using a pressurized recovery mechanism, but it may be possible to use a suction recovery mechanism described below in addition to the pressurized one or in place thereof. With the mechanism having the following suction recovery mechanism in addition to the foregoing pressurized recovery mechanism, it is possible to implement a more reliable recovery performance.

Figure 10:
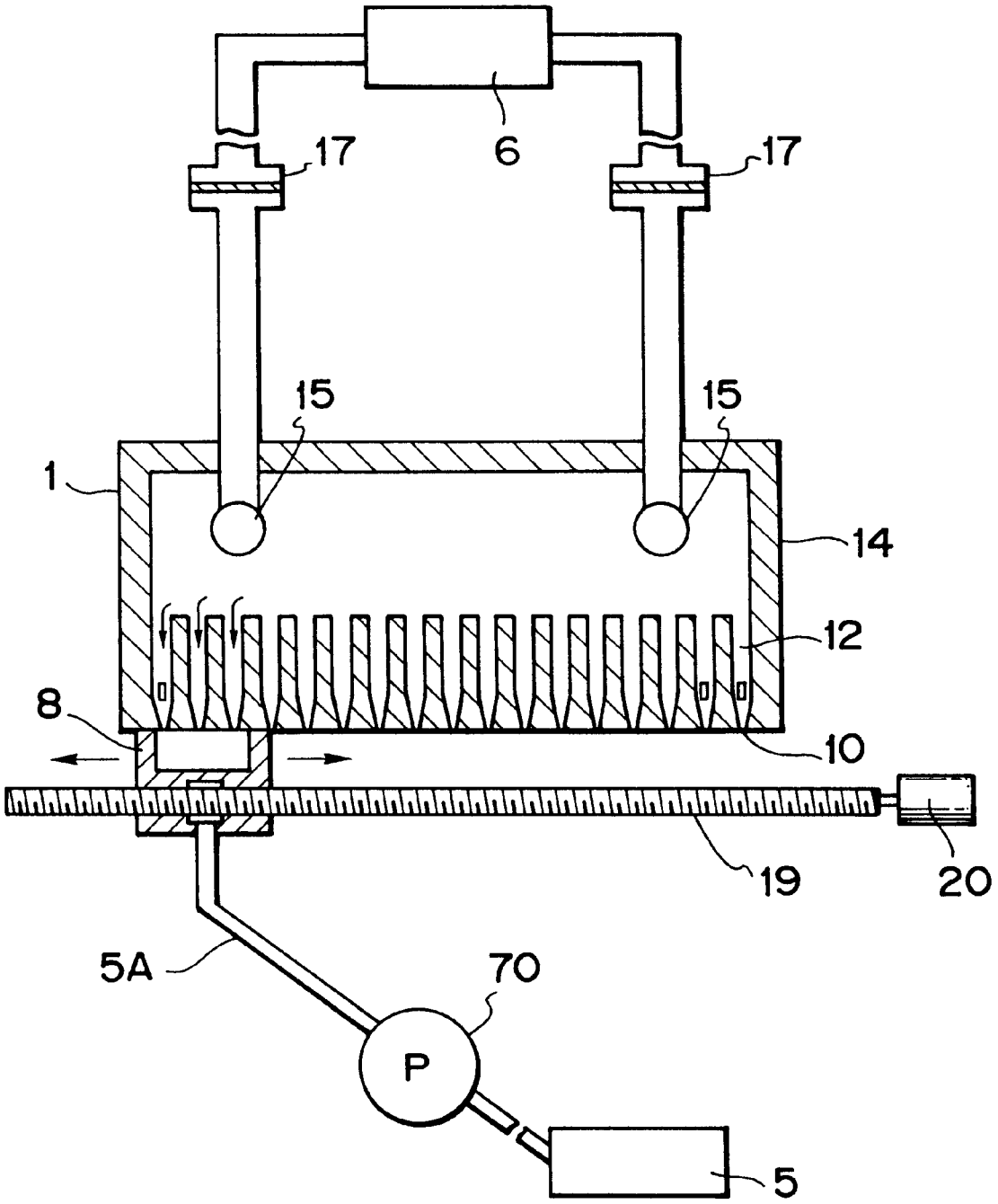
FIG. 10 is a cross-sectional view schematically showing another example of the ink jet recording apparatus for which the present invention is adopted.

FIG. 10 is a cross-sectional view schematically showing an example of the principal structure of a suction recovery mechanism only, and represents the structure of the recording head and ink suction unit at the time of a discharge recovery operation.

This example comprises a recording head 1 having a plurality of ink discharging apertures 10 arranged in a straight line, and an ink suction unit which sucks ink from the orifices 10 when a discharge recovery operation is executed.

The ink suction unit is provided with a sucking portion 8 which covers the aperture surface of a part of the orifices 10 among the plural orifices 10 in order to suck the ink therefrom, and a driving means comprising a guide screw 19 and a driving motor 20 which enable the sucking portion 8 to contact the surface of the orifices 10 and move thereon. Although not shown in FIG. 10, the sucking portion 8 of the ink suction unit and the recording head 1 are arranged to abut upon or set apart from each other by allowing them to move correlatively.

Hereinafter, the operation of this example will be described.

When a recording operation has been executed longer than a given period of time or an abnormal ink discharge has taken place, among some other cases, which necessitates an issuance of discharge recovery instruction, the recording operation is suspended, and the sucking portion 8 of the ink suction unit covers closely the orifice 10 portion on one end of the plural orifices 10 of the recording head 1 in order to suck ink by the sucking action of a pump 70 from the covered orifices 10. Then, by rotating the guide screw 19 of the driving means by use of the driving motor 20, the sucking portion 8 is being moved to the orifice 10 portion on the other end on the surface of the orifices 10 for the suction of the ink, thus enabling the entire orifices 10 to discharge the ink one portion after another while cleaning the aperture surface in the sucking portion 8. The discharged ink and the foreign substances which have been cleaned off are collected into a waste ink tank 5 by the pump 7 through a waste ink tube 5A.

The dust particles, the over viscous ink, the air bubbles, and the like in the orifices 10, which are the causes of the abnormal discharge, are exhausted together with the discharged ink when the ink is discharged from the orifices 10, thus recovering the discharging function. In this respect, it is possible to recover the discharging function effectively and perfectly by the partial suction of ink which is orderly conducted, not the simultaneous suction of ink from the entire orifices 10.

Also, by shifting the sucking portion 8 on the surface of the orifices 10, it is possible to clean off and collect the ink droplets and foreign substances adhering to the circumference of the orifices 10 for the elimination of the causes of the abnormal discharge.

In this respect, in addition to the structure which enables the sucking portion 8 to move on the surface of the orifices 10 from the one end of the orifice 10 portion to the other end of the orifice 10 portion, it may be possible to arrange a structure so that the sucking portion can be moved only in the vicinity of the orifices 10 where any defective discharge has taken place.

Further, it is preferable to form the surface of the sucking portion 8 with a resilient material. For example, it is desirable to form the surface of the sucking portion 8 with a silicon rubber or some other material that may protect the orifices 10 from being damaged or protect itself from being damaged by the surface of the orifices 10 when moving thereon. Then, it will suffice for the suction area of the sucking portion 8 if only it can suck the ink from several tens of orifices. Also, depending on the strength of the orifices 10, the surface strength of the sucking portion 8, the ink suction force, and others, the optimal values are selective for the degree of pressure and the shifting speed of the sucking portion 8 on the surface of the orifices 10.

Figure 11:
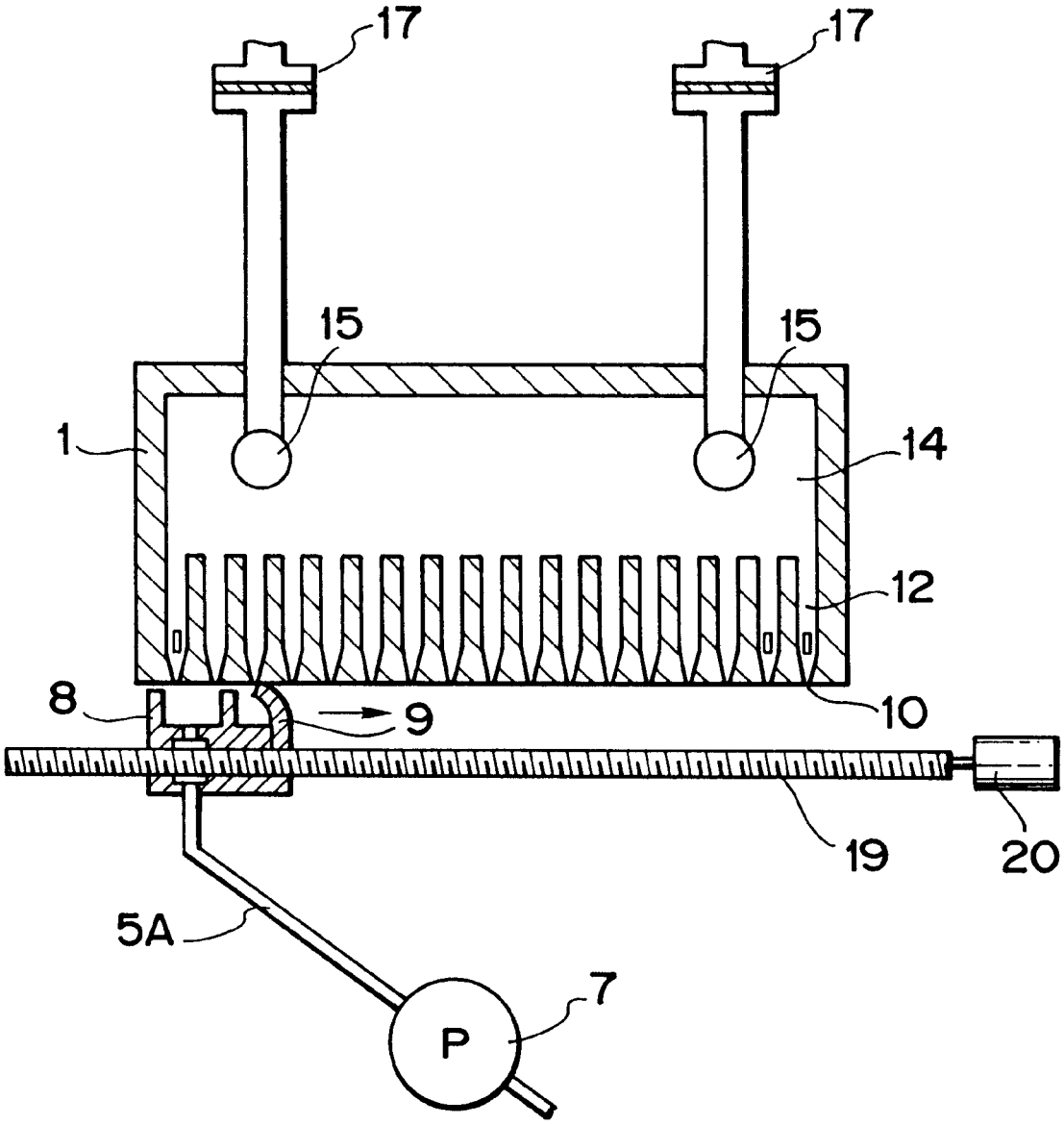
FIG. 11 is a cross-sectional view schematically showing still another example of the ink jet recording apparatus for which the present invention is adopted.

FIG. 11 is a cross-sectional view schematically showing the principal part of another mode of the ink supply recovery systems of an ink jet recording apparatus.

The sucking portion 8 of this example sucks ink from a part of the plural orifices, and then, a resilient blade 9 which is bent when abutting upon the surface of the orifices 10 is provided for the sucking portion 8.

With the structure described above, the sucking portion 8 cleans off by the use of the blade 9 the ink droplets, dust particles, and others from the orifice surface from the one end to the other end of the array of the orifices 10, while sucking the empty ink from the orifices 10 as moving to the last end of the orifice array.

In other words, by providing a blade 9 on the front side in the direction in which the sucking portion 8 moves, it becomes possible to suck the ink from the orifices after having cleaned off the orifice surface, thus removing the air bubbles and others in the nozzles 12 reliably for an excellent printing to ensue.

Figure 12:
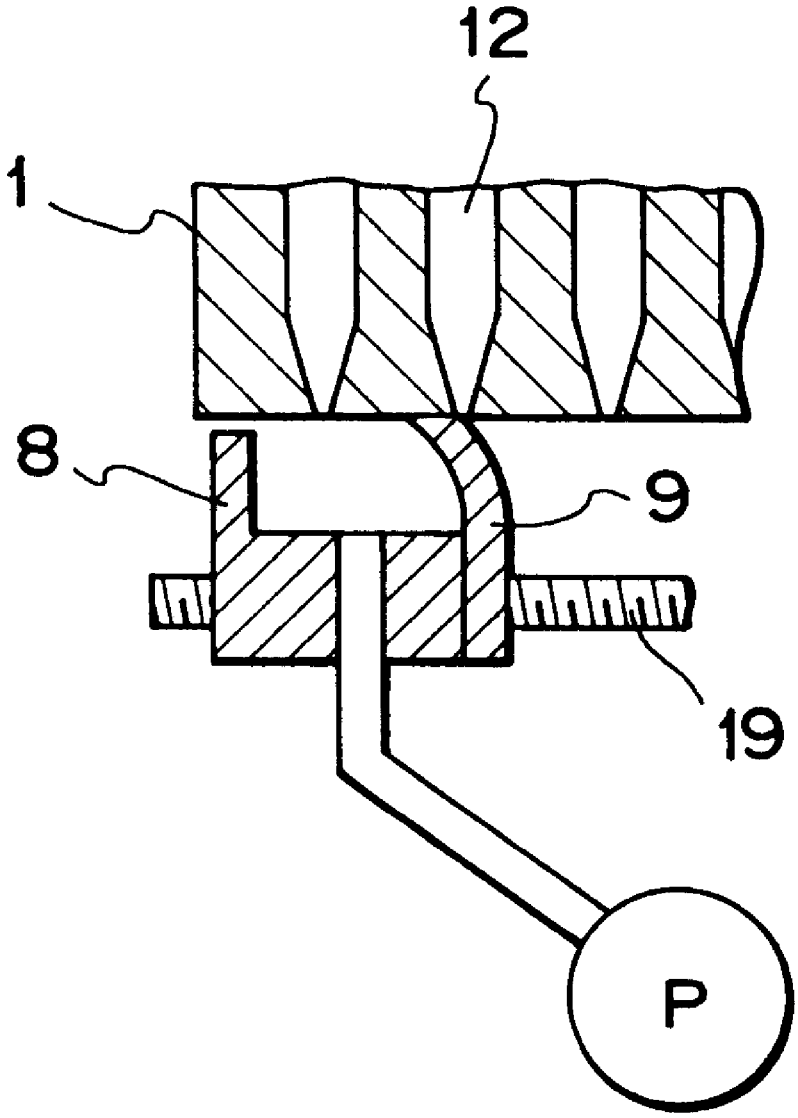
FIG. 12 is a cross-sectional view schematically showing a further example of the ink jet recording apparatus for which the present invention is adopted.

FIG. 12 is a cross-sectional view showing the principal part of another mode of the ink supply recovery systems.

As shown in FIG. 12, one of the side portions of the sucking portion 8 is formed by the blade 9 in this example in order to simplify the structure of the sucking portion 8. Thus, with the simplified structure, it is possible to obtain both the suction effect and the cleaning effect as well.

In this respect, the present invention is extremely effective and is, of course, easily executable for a recording head having a mode in which a plurality of the nozzles are arranged irrespective of the range of the arrangement or the number of the heads which corresponds to the entire width of a recording medium or to those having the arrangement or the number which is less than the foregoing ones; or to the heads for a multi type printer or a serial printer; or, further, in any cases irrespective of the structures of the ink supply systems.

Also, it is possible to arrange the structures of the sucking portion 8, moving means, and others in some other way, not necessarily confined to the structures described in each of the foregoing embodiments.

Further, the detection of any defective discharge or the position of the orifices where a defective discharge has taken place, which is necessary for the issuance of an instruction for recovering the discharging function, may be conducted visually by the operator at the time of usual recording or test recording, or may be executed by the use of a read sensor or the like after having read the result of the test recording or the like on the recording medium. Further, although the required recovery operation is executed after having determined the presence of the defective discharge subsequent to the recording process in the foregoing example, it may be possible to execute the recovery operation for the discharging function immediately after the power source is turned on or before the initiation of recording after a long-time recess.

As described above, by adopting this mechanism in addition to the foregoing pressurized recovery mechanism or by itself individually as has been exemplified, a recording is executed by discharging ink from a plurality of ink discharging apertures of a recording head, and when a discharge recovery operation is executed to recover any abnormal ink discharge and others, the sucking portion provided for an ink suction unit is used to cover a part of the ink discharging apertures among a plurality of ink discharging apertures in order to suck the ink from the covered ink discharging apertures, and then, by use of the moving means which is arranged for the ink suction unit, the sucking portion is moved on the surface of the ink discharging apertures to suck the ink, thus sucking the ink from the entire ink discharging apertures, at the same time, cleaning off and collecting the ink droplets and foreign substances adhering to the circumference of the ink discharging apertures.

By enabling the ink to be discharged from the orifices, the dust particles, over viscous ink, air bubbles, and others in the orifices which have been the cause of the abnormal discharging are exhausted together with the discharged ink for the recovery of the discharging function. In this respect, the suction is given to the entire orifices one portion after another, not entirely at once, to enable them to discharge ink by the localized suction, thus making it possible to recover the discharging function effectively and perfectly.

Also, by moving the sucking portion on the surface of the orifices, it is possible to clean off and collect the ink droplets and foreign substances adhering to the circumference of the orifices for the removal of the causes of the abnormal discharging, thus enabling a highly reliable discharge recovery process to be executed exactly.

In this respect, it is possible to arrange a structure whereby to shift the sucking portion to the vicinity of the orifices in which the defective discharging has taken place besides the structure in which the sucking portion is arranged to move from the orifice portion on the one end to the other on the orifice surface.

The above-mentioned mechanism can be arranged with a sucking portion smaller than the conventional one for covering a part of the ink discharging apertures among a plurality of discharging apertures of a recording head, and a driving means which enables the sucking portion to move on the surface of the ink discharging apertures; hence making it possible to implement the miniaturization of an apparatus and the reduction of the cost for the provision of an intended ink jet recording apparatus.

Now, as described earlier, a filter is arranged on a part of the ink supply passages of the ink supply systems of an ink jet recording apparatus in order to prevent the dust particles and other foreign substances mixed in the ink from being induced into the recording head.

Hereinafter, the description will be made of an optimal structure of the filter which can be adopted according to the present invention.

This filter can be adoptable in any one of the structures of the ink jet recording heads which have been described above. With the adoption of a filter of such a structure, it is possible to obtain a more stable condition under which the ink will be supplied.

Figure 13:
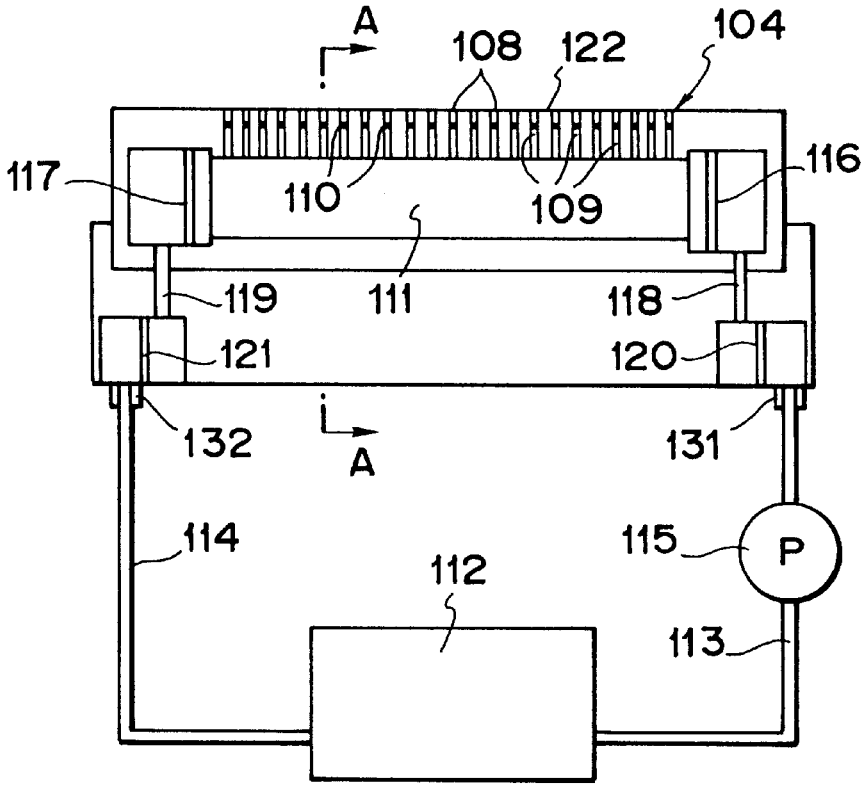
FIG. 13 is a cross-sectional view schematically showing still a further example of the ink jet recording apparatus for which the present invention is adopted.
Figure 14:
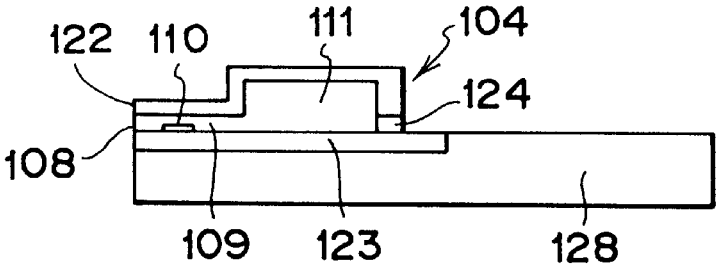
FIG. 14 is a cross-sectional view of the ink jet recording apparatus taken along the line A—A in FIG. 13.

FIG. 13 is a horizontal section schematically showing the structure of a recording head 104 and an ink supply systems. FIG. 14 is a vertical section taken along the line A—A in FIG. 13. In FIG. 13 and FIG. 14, the ink jet recording head 104 comprises a plurality of the discharging ports 108 which discharge ink; liquid passages 109 connected to each of the discharging ports 108; electrothermal transducers (heat generating elements) 110 arranged in each of the liquid passages 109 to generate the thermal energy which is utilized for discharging ink; and a common liquid chamber 111 to supply ink to each of the liquid passages 109. The plural discharging ports 108 are arranged on the front end (discharging port formation surface) 122 of the recording head 104.

Then, in accordance with image signals or discharging signals, each electrothermal transducer 110 is driven (energized) to generate film boiling in ink in the liquid passage 109 by the thermal energy generated at that time. Thus, by the utilization of the change of states (pressure changes or the like) which brings about the aforesaid film boiling, the ink is discharged from the corresponding discharging port 108 onto a recording material for recording. When this recording operation is executed, a given space (0.5 to 1.5 mm, for example) is set between the aforesaid discharging port formation surface 122 and the recording material.

In FIG. 13 and FIG. 14, a reservoir tank (ink tank) 112 retaining ink is connected to the recording head 104 through a first ink supply tube 113 and a second ink supply tube 114 for supplying the ink. The first ink supply tube 113 forms a liquid passage on the pressurized flow side, and on the way thereof, a recovery pump 115 is installed. The second ink supply tube 114 forms the liquid passage on the returning flow side. On the other hand, in the recording head 104, first filters 116 and 117 are arranged on both end portions of the common liquid chamber 111. Each of the first filters is connected to each of second filters 120 and 121 arranged on both sides of the recording head 4 by means of conductive passages 118 and 119, respectively.

Then, the first ink supply tube 113 is connected to the second filter 120 on one side, and the second ink supply tube 114 is connected to the second filter 121 on the other side. Therefore, when a recovery operation is executed, the aforesaid recovery pump 115 is actuated to supply the ink (under pressure) to the route from the reservoir tank 112→first ink supply tube 113→recovery pump 115→second filter 120→conductive passage 118→first filter 116→common liquid chamber 111. Further, the ink in the common liquid chamber 111 flows back to the reservoir tank 112 through the route from the first filter on the returning side 117→conductive passage 119→second filter 121→second ink supply tube 114→the reservoir tank 112.

In other words, when a recovery operation is executed, the ink is circulated through each of the ink supply tubes 113 and 114 and the common liquid chamber 111 so that the air bubbles and dust particles in the recording head 104 are removed. Also, in this circulation of ink, a part of the ink is exhausted from each of the discharging ports 108 in order to remove the ink which has become overly viscous and solidified in each of the liquid passages 109. Meanwhile, when a recording operation is executed, the ink is supplied to the common liquid chamber 111 through the second ink supply tube 114 because the flow resistance of the aforesaid recovery pump 115 is great.

Figure 15:
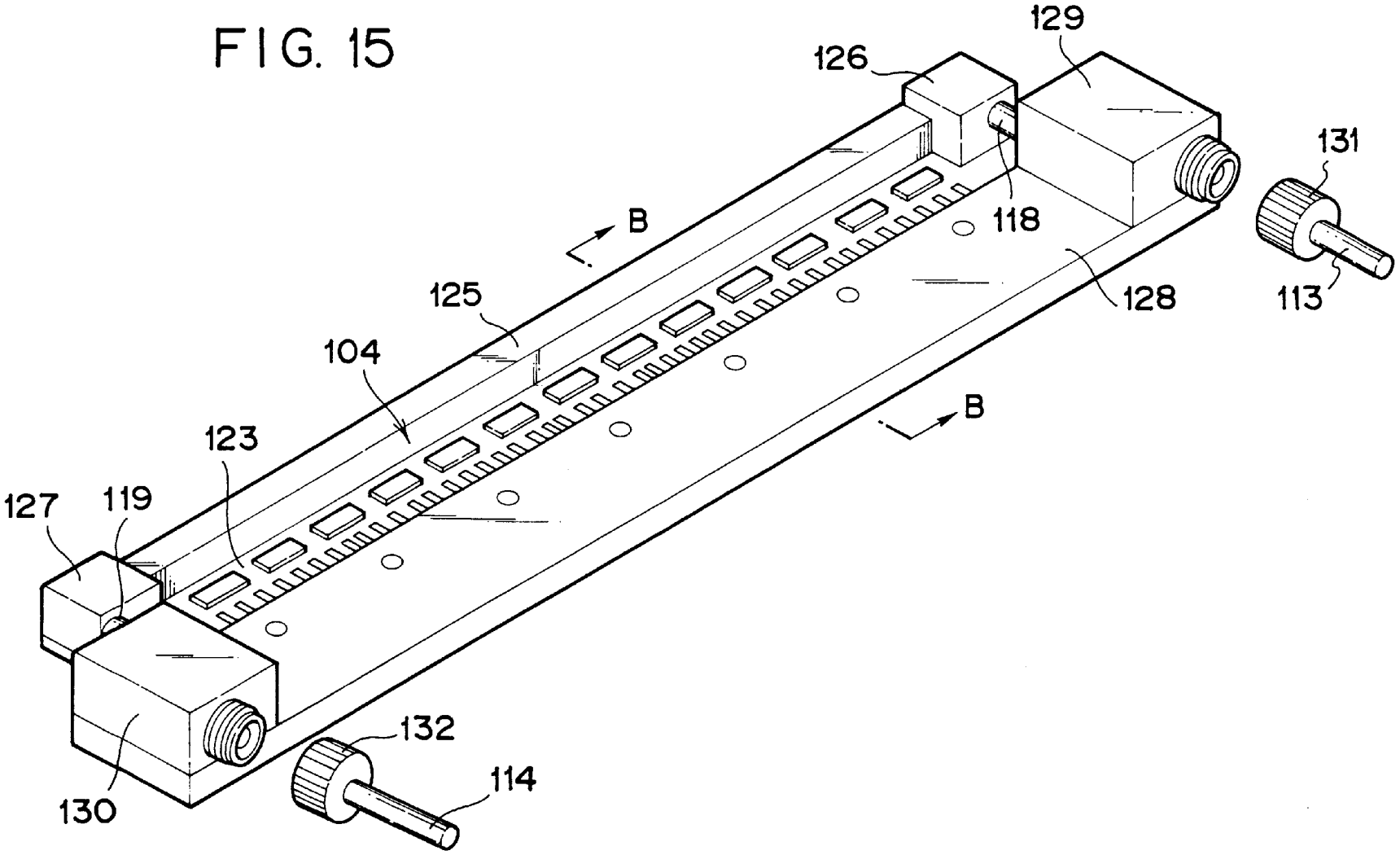
FIG. 15 is a perspective view schematically showing a recording head for which the present invention is adopted.
Figure 16:
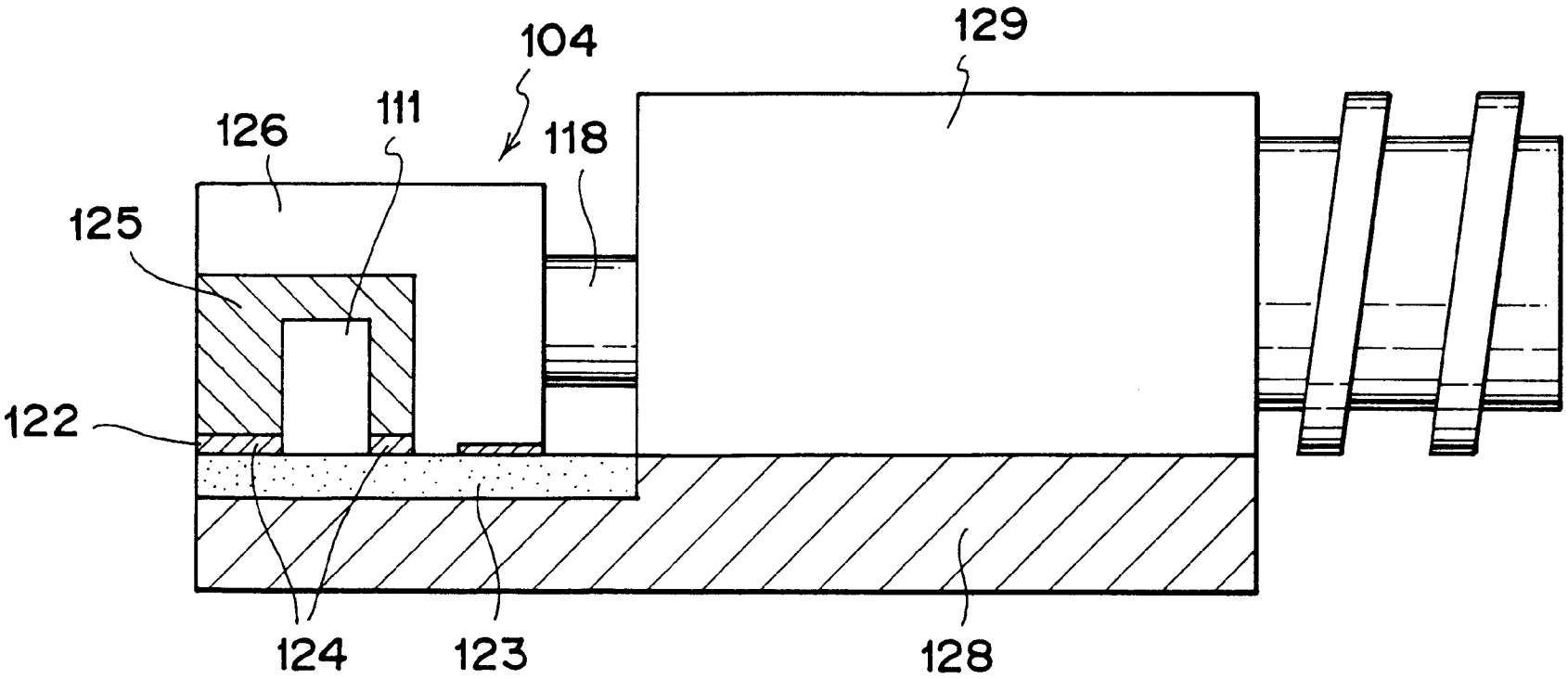
FIG. 16 is a cross-sectional view of the recording head taken along the line B—B in FIG. 15.
Figure 17:
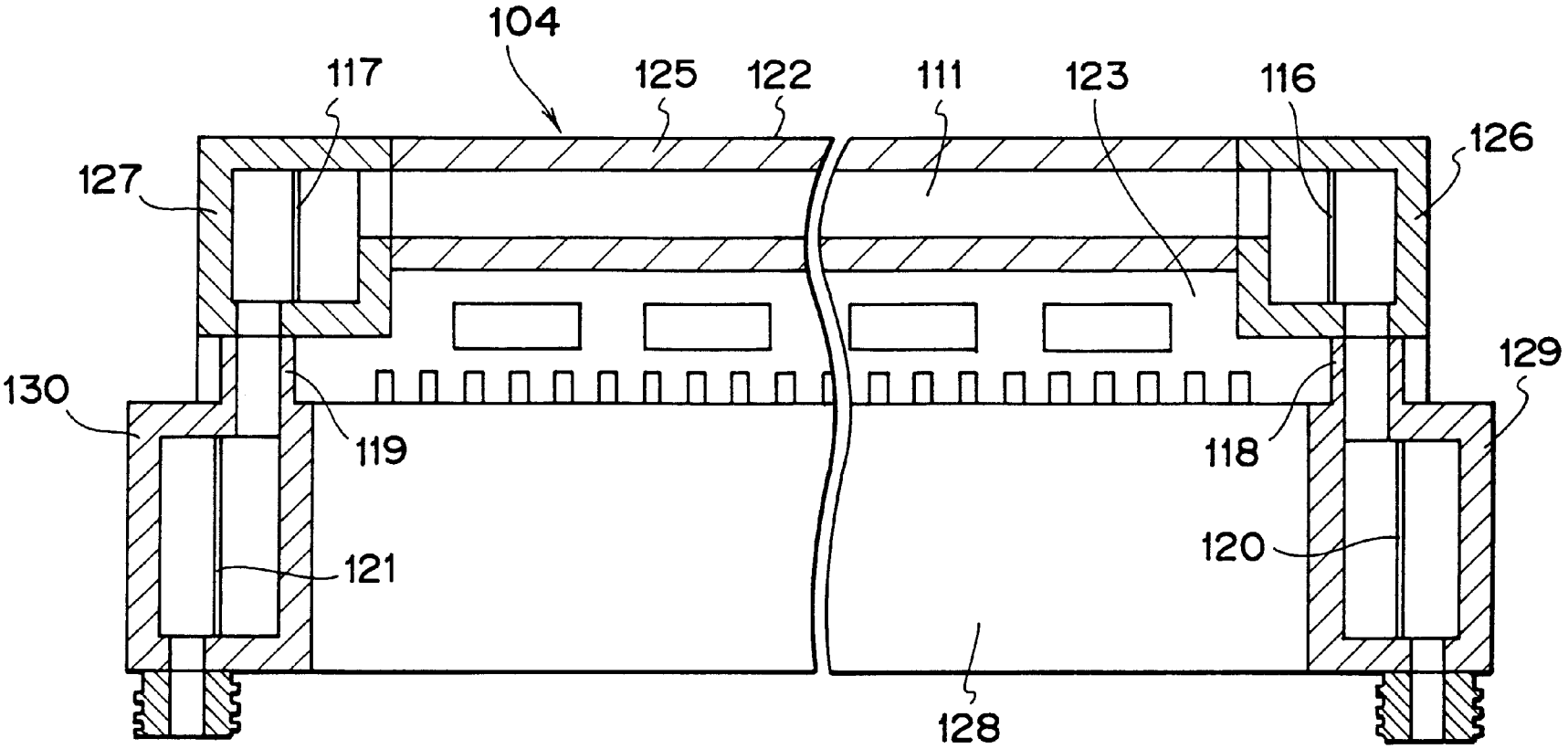
FIG. 17 is a horizontal section of the recording head shown in FIG. 15.

FIG. 15 is a perspective view showing the structure of an embodiment of the ink jet recording head 104 to which the present invention is applicable. FIG. 16 is a vertical section taken along the line B—B in FIG. 15. FIG. 17 is a partially plan section of the recording head shown in FIG. 15 which is cut horizontally. In FIG. 13 to FIG. 17, a plurality of electrothermal transducers (discharge heater) 110 and the wiring of aluminum and others for supplying electric power which are prepared by the application of the film formation technique are formed on a first substrate 123 made of silicon substrate and others. On the first substrate 123, the liquid passages 109 are formed by a solid layer (made of epoxy resin or the like, for example) 124 corresponding to each of the electrothermal transducers 110. Then, on the solid layer 124, a ceiling plate 125 is bonded. With the recess in this ceiling plate 125, the aforesaid common liquid chamber 111 is formed for supplying ink to each of the liquid passages 109.

To the first substrate 123, first filter cases 126 and 127 are fixedly bonded to connect both end portions of the common liquid chamber 111 in the foregoing ceiling plate 125. The aforesaid first filters 116 and 117 are inserted into these filter cases. Then, the first substrate 123 is positioned and bonded to the second substrate (the base plate of the recording head) 128, and is held fixedly on the second substrate. To both end portions of the second substrate 128, second filter cases 129 and 130 are fixed. The aforesaid second filters 120 and 121 are inserted into these filter cases. Then, both end portions of the first filter cases 126 and 127 and the second filter cases 129 and 130 are connected by the aforesaid conductive passages 118 and 119.

Each of the second filter cases 129 and 130 is easily and detachably joined to the first ink supply tube 113 and the second ink supply tube 114 by means of detachable tube fittings 131 and 132, respectively. In other words, each of the tube fittings 131 and 132 is connected to the recording head 104 so that the ink tank (reservoir tank) 112 and the recovery pump 115 are connected to the recording head 104, thus arranging the structure by which to supply or circulate the ink to the common liquid chamber 111 of the recording head 104.

The interior of each of the first filter cases 126 and 127 is structured to be connected to the common liquid chamber 111 formed in the aforesaid ceiling plate 125. These first filter cases are easily coupled to both end portions of the ceiling plate 125, and further, these cases are made in a size not to allow them to extrude from the first substrate 123. Also, the meshes of the first filters 116 and 117 in each of the first filter cases 126 and 127 are selected to be in a size so that the possible pressure loss will not affect the discharging capability when the ink is discharged from the entire discharging ports 108.

The aforesaid second filter cases 129 and 130 and the second filters 120 and 121 in them are to prevent any dust particles in the exterior (in the ink or in the air) from entering the common liquid chamber 111 and each of the liquid passages 109. The smaller the meshes of the second filters 120 and 121, the greater will be the effects. Also, it is necessary to make the area of the second filters 120 and 121 large in order to reduce the pressure loss. Therefore, the second filter cases 129 and 130 are arranged on the second substrate 128 which has a larger area, thus making it possible for the second filters 120 and 121 to adopt finer meshes on a larger area, respectively. Here, in the above-mentioned embodiment, the meshes of the first filters 116 and 117 are selected to be larger than those of the second filers 120 and 121 while the effective areas of the first filters 116 and 117 are selected to be smaller than the effective areas of the second filters 120 and 121.

According to the above-mentioned embodiment, since the first filters 116 and 117 are arranged in the first filter cases 126 and 127 coupled to both end portions of the ceiling plate 125 which forms the common liquid chamber 111 of the recording head 104, the shape of the of the ceiling plate 125 becomes simple without any need for the formation of holes and complicated machining, and further, the size of the common liquid chamber 111 can be determined by the required volume at the time of full discharging. Therefore, it is possible to make the ceiling 125 small as well as to make the dimension of the first substrate 123 small, thus leading to the miniaturization of the recording head 104 and the reduction of the cost.

Also, during the process of fabricating the first substrate 123, the first filter cases 126 and 127 can be mounted when the first substrate 123, solid layer 124, and ceiling plate 125 are bonded together, for example. Consequently, it becomes possible in the following fabrication process to prevent dust particles to enter the common liquid chamber 111 and liquid passages 109 by the first filters 116 and 117 already mounted. In this respect, since a process of the kind is generally executed in a clean room, there is no need for making the meshes of the first filters 116 and 117 very small. Further, when the recording head 104 is used, it is possible to prevent dust particles from entering the common liquid chamber 111 and liquid passages 109 completely from the exterior by the effects of the double filters of the first ones 116 and 117 and the second ones 120 and 121.

Figure 18:
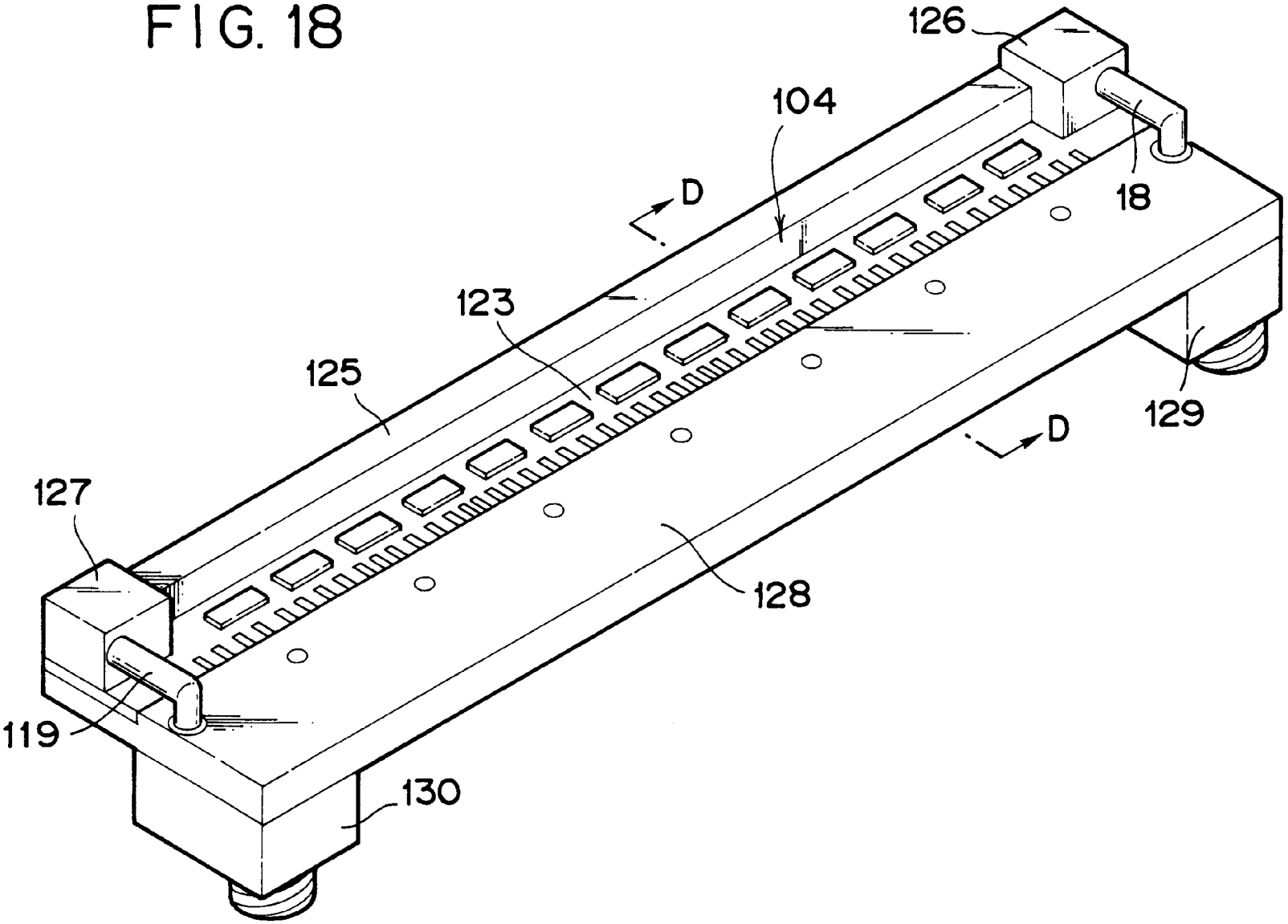
FIG. 18 is a perspective view schematically showing a recording head for which the present invention is adopted.
Figure 19:
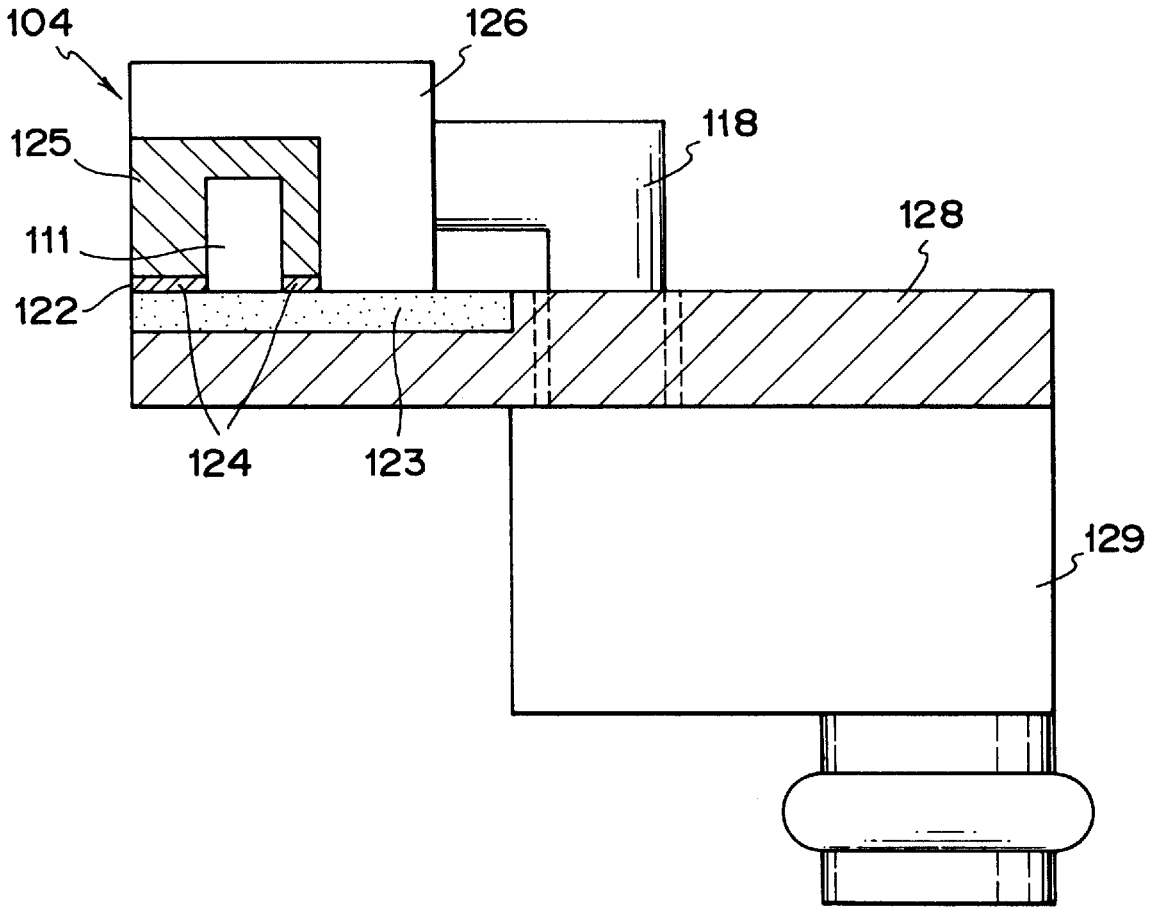
FIG. 19 is a cross-sectional view of the recording head taken along the line D—D in FIG. 18.

FIG. 18 is a perspective view showing the structure of another embodiment of the ink jet recording head to which the present invention is applicable. FIG. 19 is a vertical section taken along the line D—D in FIG. 18. In the present embodiment, the second filter cases 129 and 130 which house the second filters 120 and 121 are fixed to the surface on the side reverse to the surface of the second substrate 128 where the first substrate 123 is bonded as shown in FIG. 18 and FIG. 19. In other words, the second filter cases 129 and 130 are mounted on both sides of the lower end of the second substrate 128. Then, the conductive tubes 118 and 119 which connect the first filter cases 126 and 127 and the second filter cases 129 and 130 are arranged to penetrate both end portions of the second substrate 128 vertically.

The present embodiment differs from the foregoing embodiment in the above-mentioned aspects. All the other structures are essentially the same. Therefore, the parts corresponding to each other are referenced by the same marks, and the description will be omitted. According to the present embodiment, the second filter cases 129 and 130 which are mounted on the second substrate 128 are arranged on the surface on the reverse side of the first substrate 123, thus enabling the configuration and size of the second filter cases 129 and 130 to be selected more freely as well as the dimension of the second substrate 128 in the longitudinal direction to be equal to the length of the first substrate 123. As a result, according to the present embodiment, it is possible to obtain the effects that the prevention of the clogging due to dust particles in the recording head 104 is further improved, and at the same time, the further miniaturization of the recording head 104 becomes possible, in addition to the provision of the same effects as in the foregoing embodiment.

Also, in the foregoing embodiment, a case of a color ink jet recording apparatus provided with a plurality of recording means for recording in different colors is exemplified, but the present invention is equally applicable to an ink jet recording apparatus which records by one piece of the recording means, or an ink jet recording apparatus for gradation recording which uses a plurality of recording means for recording in the ink which has the same color but different densities, or the like, irrespective of the number of recording means (recording heads) and the combination thereof, and is capable of attaining the same functional effects. Further, in addition to the structure in which the recording head and ink tank are arranged separately and are connected by ink supply tubes or the like, the present invention is equally applicable to the structure which uses an exchangeable cartridge type recording means having a recording head and ink tank integrally formed, and various other types of ink jet recording apparatuses irrespective of the structural modes of the recording head and ink tank, and is capable of obtaining the same effects.

The double filters as described above are remarkably effective in applying them to a full-line recording head having many numbers of discharging ports arranged to cover the recordable width of a recording material width. In the full-line head, as many as approximately 2,000 to 4,000 discharging ports are arranged. Therefore, even when only one of the discharging ports becomes defective by the clogging or the like due to dust particles, the function of the entire head is adversely affected, and presents a problem of the unfavorable yield, hence leading to a serious problem cost-wise. Therefore, the ingressive dust particles in the liquid chamber and liquid passages must be reduced significantly by all means.

Figure 20:
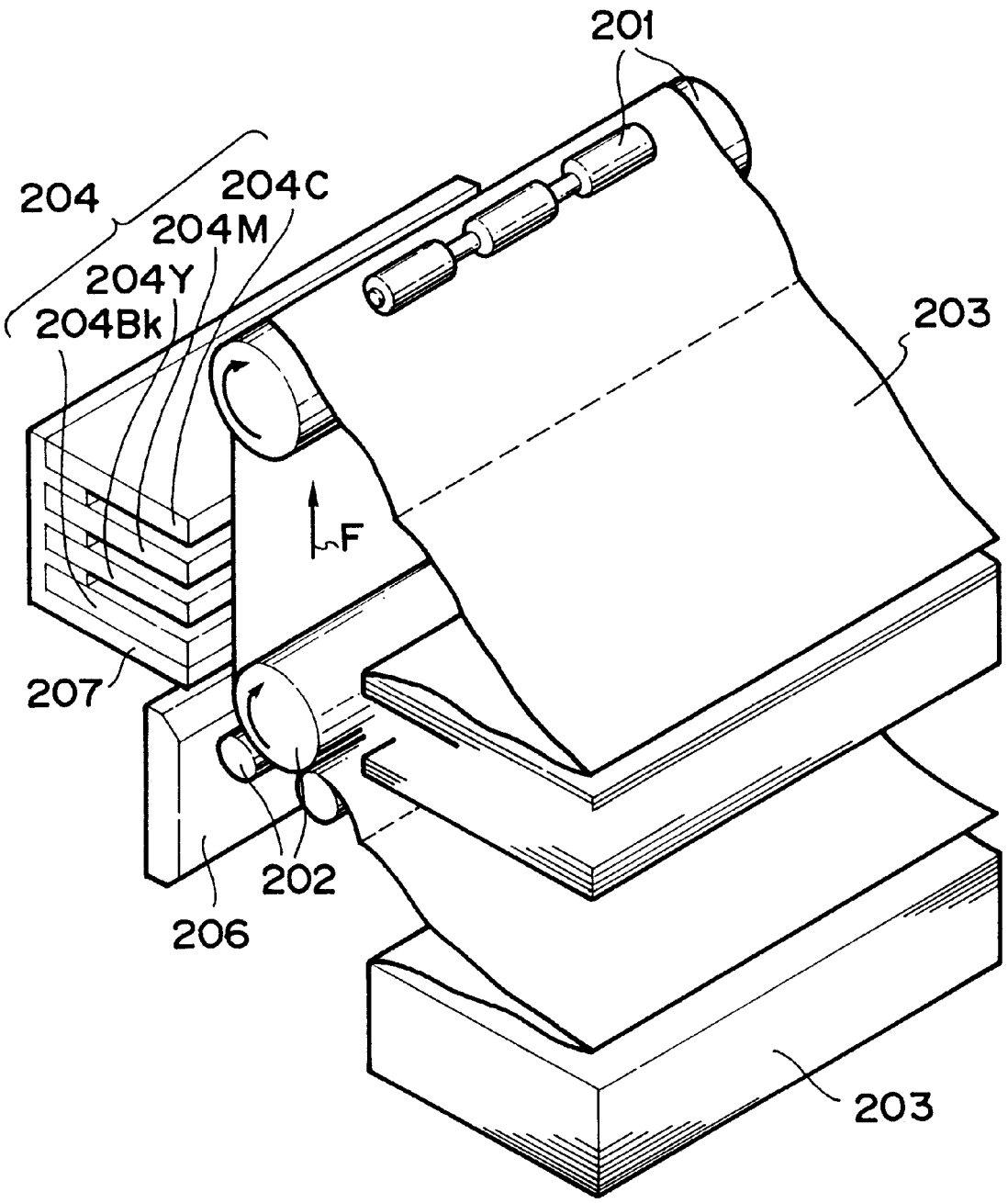
FIG. 20 is a perspective view schematically showing an ink jet recording apparatus.

Hereinafter, in accordance with FIG. 20, the description will be made of the structural outline of an ink jet recording apparatus in which the recording head of the aforesaid structure is installed. FIG. 20 illustrates a case of the ink jet recording apparatus provided with a plurality of ink jet recording heads (in the represented example, four heads) of a line type capable of executing a full-color recording. In FIG. 20, reference numerals 201 and 202 designate the roller pairs which pinch a recording material 203 such as a paper sheet or plastic thin plate and convey (sheet feed) the recording material 203 in the sub-scanning direction (feeding direction) indicated by an arrow F; and 204Bk, 204Y, 204M, and 204C, the full-multi type ink jet recording heads (ink jet recording means) 204 in which the discharging ports are arranged essentially over the entire width of the recording material 203, respectively. Here, in the following description, when any one of these recording heads is arbitrarily designated or all of them are designated, both of them are equally referred to as recording head (recording means) 204 simply.

In a case of a full-color recording, the colors of ink discharged from the above-mentioned four-recording head 204 are black, yellow, magenta, and cyanogen, for example. In the example shown in FIG. 20, the four-ink jet recording head 204 are arranged in that order from the upstream side of the feeding direction of the recording material (from the bottom in the example shown in FIG. 20). A reference numeral 206 designates the recovery systems which is arranged to prevent the defective ink discharge from each of the recording head 204. When a discharge recovery operation (processing) is executed, this recovery means moves between each recording head 204 and recording material 203 and faces the recording head 204 in place of the recording material 203, thus executing the recovery operation (recovery processing) for the recording head 204 as described earlier. Also, each ink jet recording head 204 is installed on a head installation unit 207 in such a manner as to correlatively regulate the position of each of them. With the above, it is possible to structure an ink jet recording apparatus to which the present invention is applicable, that is, the ink jet recording apparatus having the head installation unit 207 to install the ink jet recording head 204, and feeding means 201 and 202 to convey a recording material 203 to the recording position of the recording head 204 installed in the aforesaid head installation unit 207, is structured.

What is claimed is:

1. An ink jet recording apparatus comprising ink jet recording means to record by discharging an ink onto a recording material, wherein:

said recording means comprises energy generating means for generating energy to be utilized to discharge ink, a common liquid chamber, liquid passages, and discharging ports, and further comprising;

a first substrate having an area;

a second substrate having an area and at least two ends, wherein said first substrate is held by said second substrate, and said area of said second substrate is larger than said area of said first substrate;

a plurality of first filters connected to said common liquid chamber, wherein said first filters are arranged on both said ends of a ceiling plate on said first substrate;

a plurality of second filters connected to said first filters, wherein said second filters are arranged on both said ends of said second substrate; and each of said second filters is connected to an ink tank through a detachable connecting means.

2. An ink jet recording apparatus according to claim 1, wherein each of said first filters has a mesh size which is larger than a mesh size of each of said second filters.

3. An ink jet recording apparatus according to claim 1, wherein an effective area of each of said first filters is smaller than an effective area of each of said second filters.

4. An ink jet recording apparatus according to claim 1, wherein said energy generating means is an electrothermal transducer.

5. An ink jet recording apparatus as in claim 1, further comprising:

a recording head having a plurality of discharging ports for discharging the ink;

capping means for mounting on said recording head;

pressure means for pressurizing so as to cause the ink to flow under pressure in an ink supply passage to said recording head, and pressurizing an interior of said recording head when said capping means is mounted;

a first ink supply tube which provides fluid communication between said pressure means and said recording head;

a second ink supply tube which provides fluid communication between said recording head and a recording liquid reservoir container;

a conductive tube which provides fluid communication between said first ink supply tube and said second ink supply tube; and control means for controlling a flow in said conductive tube.

6. An ink jet recording apparatus as in claim 5, wherein said ink jet recording apparatus utilizes thermal energy to generate air bubbles in a recording liquid, and discharges recording droplets in accordance with development of those air bubbles.

7. An ink jet recording apparatus as in claim 1, further comprising:

a recording head having a plurality of discharging ports for discharging the ink;

capping means for mounting on said recording head;

pressure means for pressurizing so as to cause the ink to flow under pressure in an ink supply passage to said recording head, and pressurizing an interior of said recording head when said capping means is mounted;

a first ink supply tube which provides fluid communication between said pressure means and said recording head;

a second ink supply tube which provides fluid communication between said recording head and a recording liquid reservoir container; and a conductive tube which provides fluid communication between said first ink supply tube and said second ink supply tube.

8. An ink jet recording apparatus as in claim 1, further comprising:

a recording head having a plurality of ink discharging apertures;

an ink suction unit to suck the ink from said ink discharging apertures, wherein said ink suction unit comprises a sucking portion which covers a portion of all of the ink discharging apertures, and which sucks the ink therefrom; and moving means for moving said sucking portion to a surface on which are located said ink discharging apertures.

9. An ink jet recording apparatus as in claim 8, wherein said recording head has a first end and a second end and said driving means moves said sucking portion from a group of said ink discharging apertures located on said first end of said recording head to a second group of said ink discharging apertures located on said second end correlatively when the ink jet recording apparatus is not performing a recording operation.

10. An ink jet recording apparatus as in claim 8, wherein the sucking portion of said ink suction unit comprises a resilient material which is bent when said resilient material abuts upon the surface on which are located the ink discharging apertures, and said driving means enables said resilient material to abut upon the surface of the ink discharging apertures for bending, and moves said sucking portion onto on the surface of the ink discharging apertures when the ink jet recording apparatus is not performing a recording operation.

11. An ink jet recording apparatus as in claim 1, wherein said ink jet recording apparatus utilizes thermal energy to generate air bubbles in a recording liquid, and discharges recording droplets in accordance with the development of said air bubbles.

12. A recovery method of an ink jet recording head having a plurality of discharge ports to discharge ink in an ink jet recording apparatus having a plurality of ink supply passages for supplying ink to said recording head, pressure means to enable ink to flow in said plurality of ink supply passages to said recording head, a first ink supply passage of said plurality to conductively connect said pressure means and said recording head, a second ink supply passage of said plurality having a valve, said second ink supply passage to conductively connect said recording head and a recording ink reservoir container, and a conductive passage to conductively connect said first ink supply passage and said second ink supply passage, said method comprising the step of closing said valve in said second ink supply passage, so that ink is supplied under positive pressure by said pressure means to said first and second ink supply passages.

13. A recovery method as in claim 12, further comprising the step of:

providing said recording head, said recording head having a plurality of discharging ports for discharging the ink, capping means for mounting on said recording head, pressure means for pressurizing so as to cause the ink to flow under pressure in an ink supply passage to said recording head, and pressurizing an interior of said recording head when said capping means is mounted, a first ink supply tube which provides fluid communication between said pressure means and said recording head, a second ink supply tube which provides fluid communication between said recording head and a recording liquid reservoir container, a conductive tube which provides fluid communication between said first ink supply tube and said second ink supply tube, and control means for controlling a flow in said conductive tube.

14. A recovery method as in claim 13, wherein said recording head utilizes thermal energy to generate air bubbles in a recording liquid, and discharges recording droplets in accordance with development of those air bubbles.

15. A recovery method as in claim 12, further comprising the step of providing said recording head, said recording head having a plurality of discharging ports for discharging the ink, capping means for mounting on said recording head, pressure means for pressurizing so as to cause the ink to flow under pressure in an ink supply passage to said recording head, and pressurizing an interior of said recording head when said capping means is mounted, a first ink supply tube which provides fluid communication between said pressure means and said recording head, a second ink supply tube which provides fluid communication between said recording head and a recording liquid reservoir container, and a conductive tube which provides fluid communication between said first ink supply tube and said second ink supply tube.

16. A recovery method as in claim 12, further comprising the step of providing said recording head, said recording head having a plurality of ink discharging apertures, and an ink suction unit to suck the ink from said ink discharging apertures, wherein said ink suction unit comprises a sucking portion which covers a portion of all of the ink discharging apertures, sucking the ink therefrom; and moving said sucking portion to a surface on which are located said ink discharging apertures.

17. A recovery method as in claim 16, wherein said recording head has a first end and a second end and said moving step further comprises moving said sucking portion from a group of said ink discharging apertures located on said first end of said recording head to a second group of said ink discharging apertures located on said second end correlatively when the recording head is not performing a recording operation.

18. A recovery method as in claim 16, wherein the sucking portion of said ink suction unit comprises a resilient material which is bent when said resilient material abuts upon the surface on which are located the ink discharging apertures, and said moving step further comprises enabling said resilient material to abut upon the surface of the ink discharging apertures for bending, and moving said sucking portion onto the surface of the ink discharging apertures when the recording head is not performing a recording operation.

19. A recovery method as in claim 12, wherein said recording head utilizes thermal energy to generate air bubbles in a recording liquid, and discharges recording droplets in accordance with the development of said air bubbles.

20. An ink jet recording apparatus for use with a recording head having a plurality of discharging ports to discharge ink, said apparatus comprising:

an ink reservoir container for containing ink;

a first ink supply passage to conductively connect said recording head and said ink reservoir container;

a second ink supply passage to conductively connect said recording head and said ink reservoir container;

pressure means disposed in said first ink supply passage to enable ink in said ink reservoir container to flow to said recording head;

a valve disposed in said second ink supply passage; and an ink path to conductively connect said first ink supply passage and said second ink supply passage, wherein when said valve is closed, ink is supplied under positive pressure to both said first ink supply passage and said second ink supply passage by said pressure means.

21. An ink jet recording apparatus according to claim 20, further comprising capping means for capping the discharging ports of said recording head; and moving means for providing relative motion between said capping means and said recording head so as to cause said capping means to cap the discharge ports of said recording head.

22. An ink jet recording apparatus according to claim 21, wherein said moving means causes said capping means to cap the discharge ports of said recording head so as to receive ink ejected from said discharge ports in a case where ink is supplied under positive pressure to both said first ink supply passage and said second ink supply passage by said pressure means.

23. An ink jet recording apparatus according to claim 20, further comprising a second valve in said ink path, wherein when said second valve in said ink path is closed and said valve in said second ink supply passage is released pressurization by said pressure means causes ink to circulate from said ink reservoir container to said pressure means to said first ink supply passage to said recording head to said second ink supply passage and back to said ink reservoir container.

24. An ink jet recording apparatus according to claim 23, further comprising capping means for capping the discharging ports of said recording head; and moving means for providing relative motion between said capping means and said recording head so as to cause said capping means to cap the discharge ports of said recording head.

25. An ink jet recording apparatus according to claim 24, wherein said moving means causes said capping means to cap the discharge ports of said recording head so as to receive ink ejected from said discharge ports in a case where ink is supplied under positive pressure to both said first ink supply passage and said second ink supply passage by said pressure means.

* * * * *